US009121125B2

(12) United States Patent
Kim et al.

(10) Patent No.: US 9,121,125 B2
(45) **Date of Patent: *Sep. 1, 2015**

(54) METHOD FOR WASHING AND WASHING MACHINE

(71) Applicant: LG ELECTRONICS INC., Seoul (KR)

(72) Inventors: Wooyoung Kim, Seoul (KR); Youngho Kim, Seoul (KR); Jaehyun Kim, Seoul (KR); Moonhee Hong, Seoul (KR); Changoh Kim, Seoul (KR); Kyungchul Woo, Seoul (KR); Myonghun Im, Seoul (KR); Sangheon Lee, Seoul (KR); Jaewon Chang, Seoul (KR); Sooyoung Oh, Seoul (KR); Jongmin Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/310,197

(22) Filed: Jun. 20, 2014

(65) Prior Publication Data

US 2014/0366588 A1 Dec. 18, 2014

Related U.S. Application Data

(63) Continuation of application No. 12/917,737, filed on Nov. 2, 2010, now Pat. No. 8,919,154.

(30) Foreign Application Priority Data

| | | |
|---|---|---|
| Nov. 2, 2009 | (KR) | 10-2009-0105117 |
| Nov. 13, 2009 | (KR) | 10-2009-0109895 |
| Nov. 13, 2009 | (KR) | 10-2009-0109896 |
| Dec. 3, 2009 | (KR) | 10-2009-0119194 |

(51) Int. Cl.

| | |
|---|---|
| ***D06F 35/00*** | (2006.01) |
| ***D06F 39/08*** | (2006.01) |
| ***D06F 39/00*** | (2006.01) |

(52) U.S. Cl.

CPC ..... *D06F 39/088* (2013.01); *D06F 35/006* (2013.01); *D06F 39/003* (2013.01); *D06F 39/005* (2013.01); *D06F 39/083* (2013.01)

(58) Field of Classification Search

None

See application file for complete search history.

(56) References Cited

U.S. PATENT DOCUMENTS

| | | | |
|---|---|---|---|
| 1,979,006 | A | 10/1934 | Moran |
| 2,432,766 | A | 12/1947 | Kirby |
| 3,776,460 | A | 12/1973 | Fichter |
| 5,191,668 | A | 3/1993 | Euler et al. |
| 5,307,651 | A | 5/1994 | Felzer |
| 5,937,677 | A | 8/1999 | Lee |
| 2009/0249840 | A1 | 10/2009 | Jo et al. |
| 2010/0281927 | A1 | 11/2010 | Lee et al. |

FOREIGN PATENT DOCUMENTS

| | | | |
|---|---|---|---|
| CN | 1508325 | A | 6/2004 |
| CN | 1637191 | A | 7/2005 |
| DE | 4330079 | | 3/1995 |

(Continued)

*Primary Examiner* — Jason Ko

(74) *Attorney, Agent, or Firm* — Dentons US LLP

(57) ABSTRACT

Provided is a washing machine. The washing machine includes a cabinet, a drum, and a whirling nozzle. The cabinet defines the exterior. The drum is provided in the cabinet, and rotates with laundry held therein. The whirling nozzle changes wash water into whirling water to spray the whirling water into the drum.

7 Claims, 17 Drawing Sheets

(56) References Cited

FOREIGN PATENT DOCUMENTS

| | | | |
|---|---|---|---|
| DE | 102007023020 | B3 | 5/2008 |
| EP | 1555340 | A2 | 7/2005 |
| EP | 1700943 | | 9/2006 |
| JP | H10263282 | | 10/1998 |
| JP | 2002136793 | | 5/2002 |
| JP | 2005193003 | | 7/2005 |
| JP | 2007202638 | | 8/2007 |
| JP | 2008126139 | | 6/2008 |
| JP | 4143321 | | 9/2008 |
| JP | 2008237441 | | 10/2008 |
| JP | 2009039435 | | 2/2009 |
| KR | 1020020065072 | A | 8/2002 |
| KR | 10088157 | | 1/2009 |
| WO | 2008075198 | A2 | 6/2008 |

METHOD FOR WASHING AND WASHING MACHINE

This application is a continuation of U.S. application Ser. No. 12/917,737, filed Nov. 2, 2010, which claims priority from Korean Patent Application No. 10-2009-0119194 filed on Dec. 3, 2009, Korean Patent Application No. 10-2009-0105117 filed on Nov. 2, 2009, Korean Patent Application No. 10-2009-0109895 filed on Nov. 13, 2009, and Korean Patent Application No. 10-2009-0109896 filed on Nov. 13, 2009 in the Korean Intellectual Property Office, the disclosure of each of the above applications is incorporated herein by reference in its entirety.

BACKGROUND OF THE INVENTION

1. Field of the Invention

The present invention relates to a washing method and washing machine, and more particularly, to a washing method and washing machine with improved washing performance.

2. Description of the Related Art

In general, a washing machine is an apparatus that uses water, detergent, and mechanical action to wash clothing, bed linen, etc. (hereinafter referred to as 'laundry') by performing wash, rinse, and spin cycles to remove contaminants from the laundry.

Washing machines are categorized into agitator type, pulsator type, and drum type washing machines.

An agitator type washing machine performs washing by left and right rotation of a washing agitator projecting upward in the center of a wash tub, a pulsator type washing machine performs washing by employing friction between whirling water and laundry through rotating left and right a round plate shaped rotating wing formed on the bottom of a wash tub, and a drum type washing machine performs washing by rotating a drum filled with water, detergent, and laundry.

A drum washing machine has a tub installed inside a cabinet defining the exterior of the washing machine to hold wash water, a drum disposed inside the tub to hold laundry, a motor installed at the rear side of the tub to rotate the drum, and a driveshaft installed on the motor, passed through the tub, and connected to the reverse side of the drum. A lifter is installed within the drum to lift laundry when the drum rotates.

Various efforts are being made to improve the washing performance of such drum washing machines.

SUMMARY OF THE INVENTION

An object of the present invention is to provide a washing method and washing machine with improved washing performance.

Objects of the present invention are not limited to that above, and other objects will become apparent to those skilled in the art from the description below.

According to an aspect of the present invention, there is provided a washing machine comprising: a cabinet defining the exterior; a drum provided in the cabinet, and rotating with laundry held therein; and a whirling nozzle changing wash water into whirling water to spray the whirling water into the drum.

The whirling nozzle may spray the wash water on an inner side surface and an inner rear surface of the drum.

The wash water may be changed into the whirling water to be dispersedly sprayed on the inner side surface and the inner rear surface of the drum.

The wash water may be changed to whirling water to perform a translational motion or a circular motion.

The wash water may be changed into the whirling water to be atomized.

The washing machine may further include: a tub provided in the cabinet and holding the drum; and a gasket provided between the cabinet and the tub. Here, the whirling nozzle may be provided at an upper portion of the gasket.

The gasket may have a first protrusion and a second protrusion protruding at an upper portion of an inner circumferential surface of the gasket, and the whirling nozzle is provided between the first protrusion and the second protrusion.

The whirling nozzle may be a spray nozzle spraying wash water supplied from an external water source into the drum.

The washing machine may further include: a water supply valve unit supplying the wash water from the external water source; a second water supply valve provided in the water supply valve unit to control a flow of the wash water; and a second water supply hose connecting the second water supply valve and the spray nozzle.

The washing machine may further include a circulation nozzle spraying circulating wash water into the drum. Here, the circulation nozzle may be a whirling nozzle formed independently of the spray nozzle.

The washing machine may further include a circulation nozzle spraying circulating wash water into the drum. Here, the circulation nozzle may include: a main body having a flow path through which the circulating wash water passes; and a bent surface which the wash water having passed the main body runs against and is bent to be sprayed from.

The whirling nozzle may spray circulating wash water into the drum.

The washing machine may further include: a tub holding the circulating wash water; a pump circulating the wash water in the tub; and a circulation flow path connecting the pump and the circulation nozzle.

The washing machine may further include a spray nozzle spraying wash water supplied from an external water source into the drum. Here, the spray nozzle may be the whirling nozzle formed independently of the circulation nozzle.

The washing machine may further include a spray nozzle spraying wash water supplied from an external water source into the drum. Here, the spray nozzle may include: a main body having a flow path through which the wash water supplied from the external water source passes; and a bent surface which the wash water having passed the main body runs against and is bent to be sprayed from.

The whirling nozzle may spray wash water supplied from an external water source and circulating wash water into the drum.

The washing machine may further include: a water supply valve unit supplying wash water from an external water source; a second water supply valve provided in the water supply valve unit to control a flow of the wash water; and a second water supply hose connecting the second water supply valve and the whirling nozzle; a tub holding wash water; a pump circulating the wash water in the tub; and a circulation flow path connecting the pump and the whirling nozzle.

The whirling nozzle may have a plurality of twisted flow paths formed therein to change the wash water into whirling water.

The cabinet may have a laundry loading hole allowing the laundry to go in and out, and the cabinet may further include: a door opening and closing the laundry loading hole; and a nozzle having a door spray portion from which wash water is sprayed to the door.

The cabinet may have a laundry loading hole allowing the laundry to go in and out. The cabinet further may include a door opening and closing the laundry loading hole. The whirling nozzle may have a door spray portion from which wash water is sprayed to the door.

According to another aspect of the present invention, there is provided a washing machine including: a cabinet defining the exterior; a drum provided in the cabinet, and rotating with laundry held therein; and a whirling nozzle having a plurality of twisted flow paths therein and spraying wash water passing through the flow path into the drum.

The whirling nozzle may include: a dome having a hemispherical shape at one side thereof and having a receiving space therein; a core provided in the receiving space and formed of a twisted plate; and a spray nozzle cap from which the wash water passing through the flow path that the core and the hold space form is sprayed.

The wash water may be revolved when passing through the flow path that the core and the receiving space form.

According to another aspect of the present invention, there is provided a washing machine including: a cabinet defining the exterior; a drum provided in the cabinet, and rotating with laundry held therein; and a whirling nozzle revolving wash water to discharge the revolved wash water into the drum.

The whirling nozzle may have a twisted flow path to revolve the wash water.

The effects of the present invention are not limited to the above-mentioned effects, and other effects not mentioned above can be clearly understood from the definitions in the claims by one skilled in the art.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Figure 1:
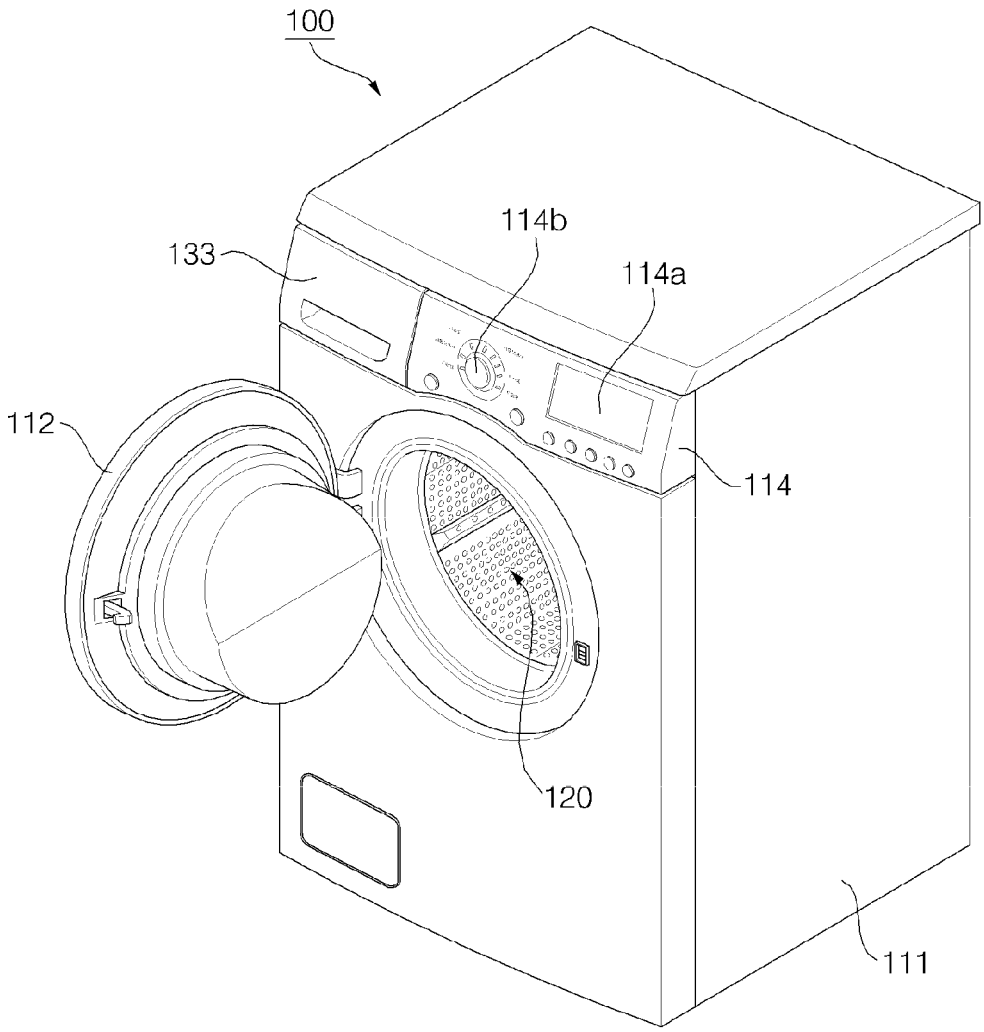
FIG. 1 is a view illustrating a washing machine according to an embodiment of the present invention.

The foregoing and other objects, features, aspects and advantages of the present invention will become more apparent from the following detailed description of the present invention when taken in conjunction with the accompanying drawings. Exemplary embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions may be exaggerated for clarity, and the same reference numerals will be used throughout to designate the same or like components.

Hereinafter, exemplary embodiment of the present invention will be described in detain with the accompanying drawings.

Figure 2:
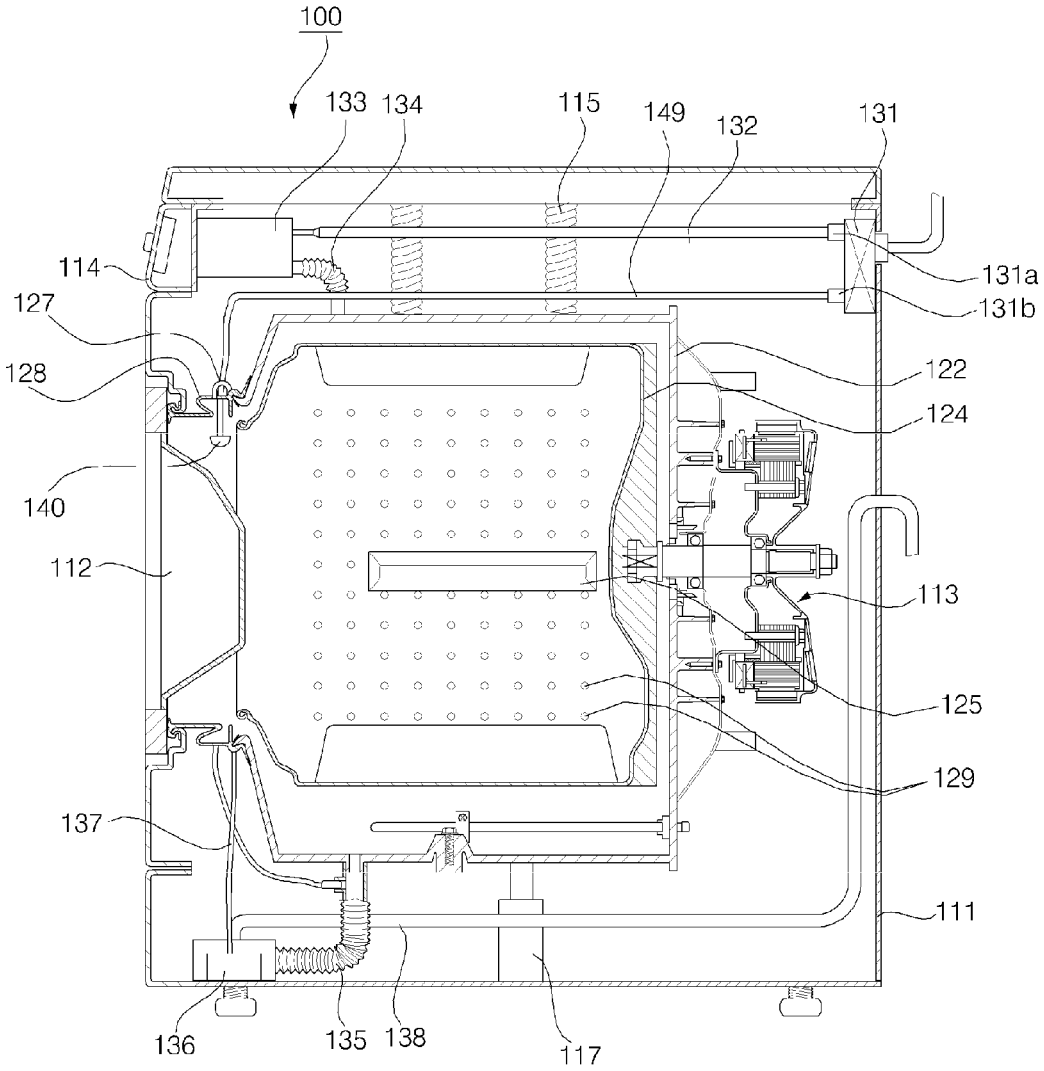
FIG. 2 is a cross-sectional view illustrating the washing machine of FIG. 1.
Figure 3:
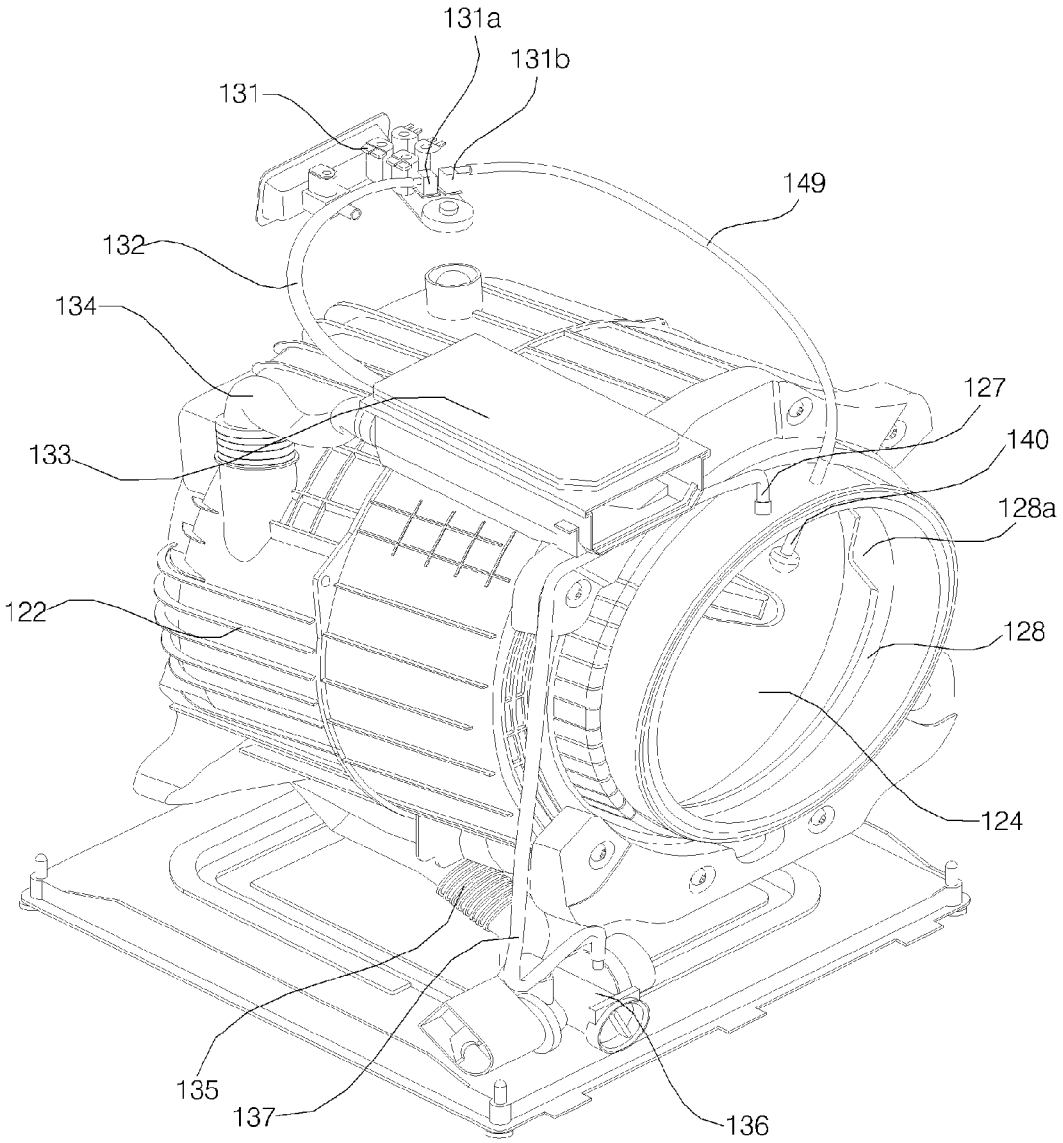
FIG. 3 is a perspective view illustrating a washing machine from which a cabinet of FIG. 1 is removed.

FIG. 1 is a view illustrating a washing machine according to an embodiment of the present invention, FIG. 2 is a cross-sectional view illustrating the washing machine of FIG. 1, and FIG. 3 is a perspective view illustrating a washing machine from which a cabinet of FIG. 1 is removed.

A washing machine 100 according to an embodiment of the present invention may include a cabinet 111 defining the exterior, a drum 124 provided to rotate within the cabinet 111 and in which laundry is inserted, a tub 122 provided inside the cabinet 111 and housing the drum 124, a gasket 128 provided between the cabinet 111 and the tub 122, and a spray nozzle 140 changing wash water to whirling water and spraying into the drum 124. Also included are a door 112 provided at the front surface of the cabinet 111 to open and close a laundry loading hole 120 through which laundry is introduced into the cabinet 111, a driving unit 113 that applies torque to rotate the drum 124, a detergent box 133 for holding detergent, and a control panel 114 that receives a user input and displays the state of the washing machine 100.

The cabinet 111 may define the laundry loading hole 120 to enable loading of laundry. The door 112 may be pivotably provided on the front surface of the cabinet 111 to open and close the laundry loading hole 120. The control panel 114 may be provided on the cabinet 111 to receive a command from a user and display information on various aspects of the washing machine 100. The detergent box 133 may be provided on the cabinet 111 to be insertable and withdrawable and hold washing agents such as detergent, fabric softener, and bleach.

The tub 122 may be disposed in the cabinet 111 to be cushioned by a spring 115 and a damper 117. The tub 122 may hold wash water. The drum 124 may be disposed inside the tub 122.

The drum 124 may hold laundry and rotates. The drum 124 may define a plurality of through-holes 129 to allow wash water to pass therethrough. A lifter 125 may be disposed on the inner wall of the drum 124 to lift laundry a certain height when the drum 124 rotates. The drum 124 may receive rotating force from the driving unit 113 to rotate.

The gasket 128 may be provided between the tub 122 and the cabinet 111 to seal the tub 122 and cabinet 111. The gasket 128 may be disposed between the entrance of the tub 122 and the loading hole 120. The gasket 128 may absorb shock transmitted to the door 112 when the drum 124 rotates, and also may prevent wash liquid from within the tub 122 from leaking to the outside. A circulating nozzle 127 and a spray nozzle 140 may be provided on the gasket 128 to introduce wash water into the drum 124.

The gasket 128 may be formed integrally of a single material, and may be formed of a robust material at the portion coupled to the tub 122, in order to ensure adequate fastening strength with the tub 122 and rigidity. The portion that couples to the cabinet 111 may be formed of a material having elasticity to absorb vibrations transferred from the tub 122 to the cabinet 111.

The driving unit 113 may rotate the drum 124. The driving unit 113 may rotate the drum 124 at various speeds or different directions. The driving unit 113 may include a motor and a switching device for controlling the motor, a clutch, etc.

The detergent box 133 may hold washing agents such as washing detergent, fabric softener, and bleach. The detergent box 133 may be provided to be withdrawable to the front of the cabinet 111. The detergent in the detergent box 133 may be mixed with wash water and may enter the tub 122 when wash water is supplied. The detergent box 133 may be divided into a portion that holds washing detergent, a portion that holds fabric softener, and a portion that holds bleach.

The inside of the cabinet 111 may include a water supply valve unit 131 for controlling the influx of wash water from an external water source, a first water supply hose 132 that allows wash water that flows into the water supply valve unit 131 to flow to the detergent box 133 by means of a first water supply valve 131*a*, and a water supply hose 134 that allows wash water mixed with detergent to flow from the detergent box 133 into the tub 122. The water supply valve unit 131 may also have a second water supply valve 131*b* and a second water supply hose 149 connected to the spray nozzle 140. The first water supply valve 131*a* and the second water supply valve 131*b* may open and close the first water supply hose 132 and second water supply hose 149, respectively, and may supply water from the external water source entering the water supply valve unit 131 to the first water supply hose 132 and second water supply hose 149.

The inside of the cabinet 111 may include a drain pipe 135 through which wash water inside the tub 122 is drained, a pump 136 for draining wash water in the tub 122, a circulation passage 137 that circulates wash water, a circulation nozzle 127 for directing flow of wash water into the drum 124, and a drain passage 138 for draining wash water to the outside. According to embodiments, the pump 136 may be provided as a circulation pump and a drain pump connected to the circulation passage 137 and the drain passage 138, respectively.

The control panel 114 may include an input unit 114*b* through which a washing course selection, operating times for each cycle, presettings, and various other operating commands are input by a user, and a display unit 114*a* that displays the operating state of the washing machine 100.

The washing course may include, in addition to a normal course, various courses according to the type or function of laundry, such as a lingerie/wool course, a steam course, a quick wash course, a functional garment course, a gentle course to prevent damage to laundry, and a silent course. The operations of the washing machine 100 may be divided into a wash cycle, a rinse cycle, and a spin cycle, and in each cycle, supplying water, washing, rinsing, draining, spinning, and/or drying are performed.

The spray nozzle 140 may spray wash water that flows in from an external water source through the second water supply hose 149 provided on the gasket 128 into the drum 124. The spray nozzle 140 may be provided at the upper portion of the gasket 128, and according to embodiments, may be disposed in various locations including the lower portion of the gasket 128, between the gasket 128 and cabinet 111, in the cabinet 111, and in the tub 122. When the door 112 closes the loading hole 120, a portion of the door 112 may enter the drum 124. The spray nozzle 140 may be disposed so as not to interfere with the portion of the door 112 that enters the drum 124. When the door 112 closes the loading hole 120, the spray nozzle 140 is provided at a predetermined space from the door 112.

The spray nozzle 140 may spray wash water into the drum 124. In the present embodiment, the spray nozzle 140 may be a whirling nozzle that revolves and discharges wash water to the inner side surface 124*a* and inner rear surface 124*b* of the drum 124.

A whirling nozzle may be a nozzle that allows wash water to undergo a translational motion and a circular motion. The whirling nozzle may be embodied in various forms, and may change wash water into whirling water to spray into the drum 124 via a plurality of twisted passages.

The spray nozzle 140 may operate in a rinse cycle (described below) from among the cycles of the washing machine 100, but is not limited thereto, and may operate in other cycles as well. The configuration and operation of the spray nozzle 140 will be described below.

The circulation nozzle 127 may spray wash water circulated through the circulation passage 137 into the drum 124. The circulation nozzle 127 may be provided at the top of the gasket 128, and according to embodiments, may be provided in various locations, including at the bottom of the gasket 128, between the gasket 128 and cabinet 111, in the cabinet 111, and in the tub 122.

The circulation nozzle 127 may spray wash water into the drum 124. In the present embodiment, the circulation nozzle 127 may be a whirling nozzle that revolves and discharges wash water at the inner side surface 124*a* and inner rear surface 124*b* of the drum 124, and may change wash water to whirling water through a plurality of formed twisted passages to spray into the drum 124.

The wash water housed in the drum 124 may move along the drain pipe 135 provided on the tub 122 to the pump 136. The pump 136 may move wash water through the circulation passage 137 to the circulation nozzle 127. The wash water may flow back into the drum 124 by means of the circulation nozzle 127

The circulation nozzle 127 may be provided adjacent to the spray nozzle 140. The circulation nozzle 127 may be positioned at an upper portion of the gasket 128 where the spray nozzle 140 is located, and operates together with the spray nozzle 140 during washing machine 100 operation, or alone. The configuration and operation of the circulation nozzle 127 will be described below.

According to embodiments, the spray nozzle 140 and circulation nozzle 127 may be integrally provided. That is, one whirling nozzle may be configured to perform the functions of the spray nozzle 140 and circulation nozzle 127. The whirling nozzle may be connected to the second water supply hose 149 and the circulation passage 137 through a Y-shaped pipe, and discharge wash water supplied from an external water supply, or may discharge wash water circulated through the circulation passage 137.

The water supply valve unit 131 may supply wash water from an external water supply into the drum 124. The water supply valve unit 131 may include a first water supply valve 131*a* and a second water supply valve 131*b* for moving wash water. The first water supply valve 131*a* and second water supply valve 131*b* may be opened to control the flow of wash water to the first water supply hose 132 and second water supply hose 149 connected thereto, respectively.

The water supply valve unit 131 may include a hot water valve (not shown), a bleach valve (not shown), a prevalve (not shown), a main valve (not shown), and a system valve (not shown). The hot water valve may control hot water supplied from an external water supply to supply hot water to the detergent box 133. The bleach valve may supply wash water to the portion of the detergent box 133 that stores bleach. The prevalve may be used at the start of a wash cycle and supplies wash water through the detergent box 133 into the drum 124. Here, the wash water that may be supplied through the prevalve does not pass detergent and is supplied into the drum 124. The wash water supplied through the main valve may pass through the portion of the detergent box 133 storing detergent and may be supplied into the drum 124 together with the detergent. The steam valve may supply wash water to a steam hose (not shown) connected to a steam module (not shown). In the final cycle in which the fabric softener is supplied, the main valve and prevalve may operate together to supply wash water to the portion of the detergent box 133 containing fabric softener. In a regular rinse cycle for rinsing detergent, the bleach valve, main valve, and prevalve may operate to supply wash water into the drum 124. Each of the above valves may, according to embodiments, be combined with two or more to perform the respective functions. Also, any one of the above described valves may serve as the first water supply valve 131*a*, and any one of the hoses connected to the respective valves and to the detergent box 133 may serve as the first water supply hose 132.

The first water supply hose 132 may connect the first water supply valve 131*a* and the detergent box 133. The wash water flowing in the first water supply valve 131*a* may flow through the first water supply hose 132 and may reach the detergent box 133, and the wash water that is mixed with detergent in the detergent box 133 may flow through the water supply pipe 134 into the drum 124.

A whirling nozzle may be provided on the water supply pipe 134, in which case revolving wash water is discharged through the water supply pipe 134.

The second water supply hose 149 may directly connect the second water supply valve 131*b* to the spray nozzle 140. The wash water supplied from an external water supply and moving in the second water supply valve 131*b* may flow through the second water supply hose 149 and may reach the spray nozzle 140. The wash liquid that reaches the spray nozzle 140 may be changed to whirling water through the spray nozzle 140 and may be sprayed into the drum 124. A description of wash water being changed to whirling water will be made below with reference to FIG. 6.

Figure 4:
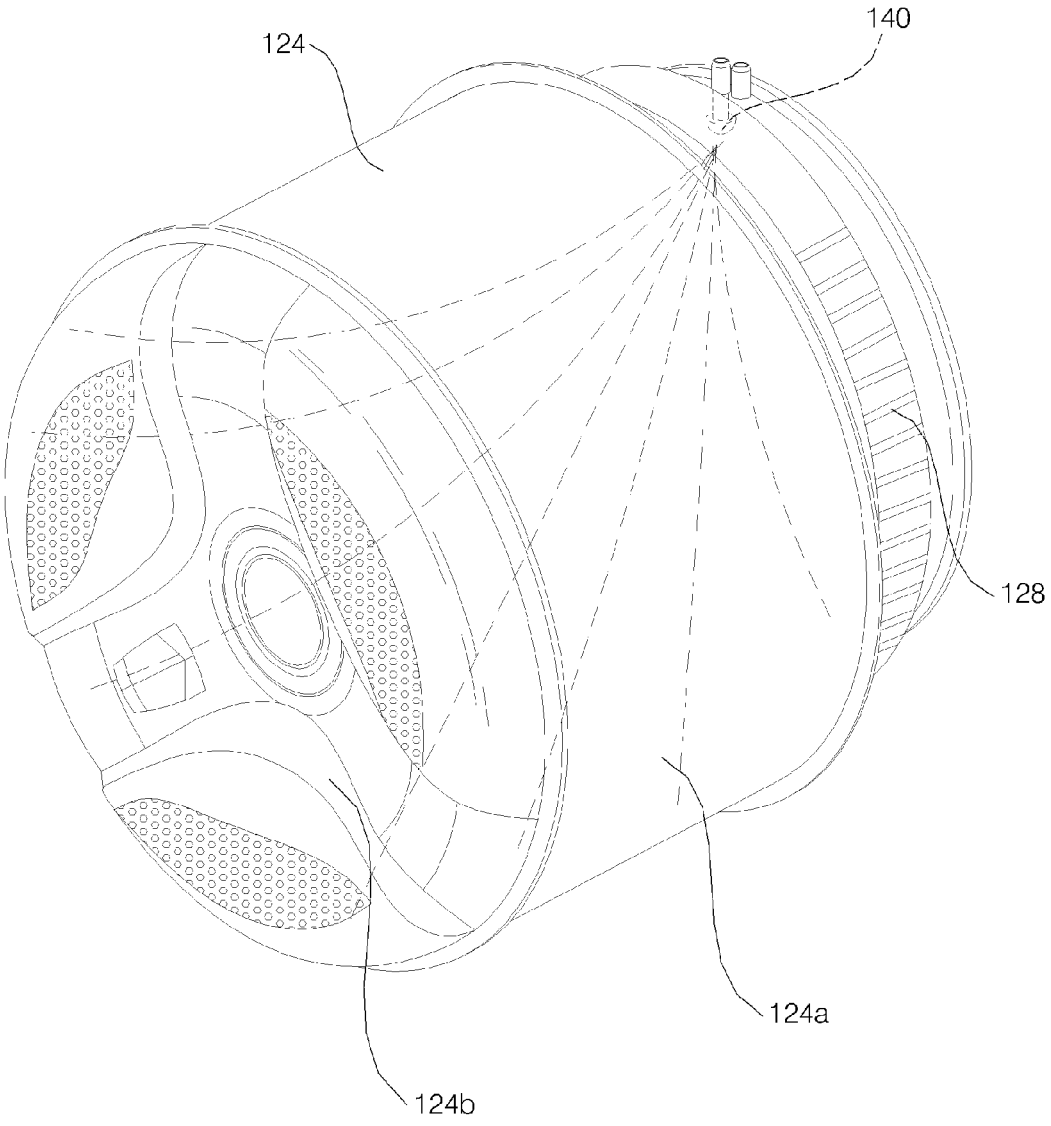
FIG. 4 is a view illustrating a spray nozzle of a washing machine according to an embodiment of the present invention sprays wash water into a drum.

FIG. 4 is a view illustrating an injection nozzle of a washing machine according to an embodiment of the present invention injects into a drum.

Referring to FIG. 4, the spray nozzle 140 may spray wash water on the inner side surface 124*a* of the drum 124 and the inner rear surface 124*b* of the drum 124. The wash water sprayed from the spray nozzle 140 onto the inner side surface 124*a* of the drum 124 corresponding to the outer surface of the drum 124, and onto the inner rear surface 124*b* corresponding to the bottom surface of the drum may be filled.

The spray nozzle 140 may spray wash water on the entire inner side surface 124*a* of the drum 124 and a portion of the inner rear surface 124*b*, and may spray wash water on the entire inner side surface 124*a* of the drum 124 and the entire inner rear surface 124*b*.

In the present embodiment, the spray nozzle 140, which is a whirling nozzle revolving wash water to discharge, may change wash water to whirling water that moves in a translational motion and a circular motion.

Through centrifugal force caused by the whirling water, the wash water may be distributed and may be sprayed on the inner side surface 124*a* of the drum 124 and the inner rear surface 124*b*. Also, through the centrifugal force caused by the whirling water, wash water may be atomized to be quickly absorbed into laundry and pass through.

Figure 5:
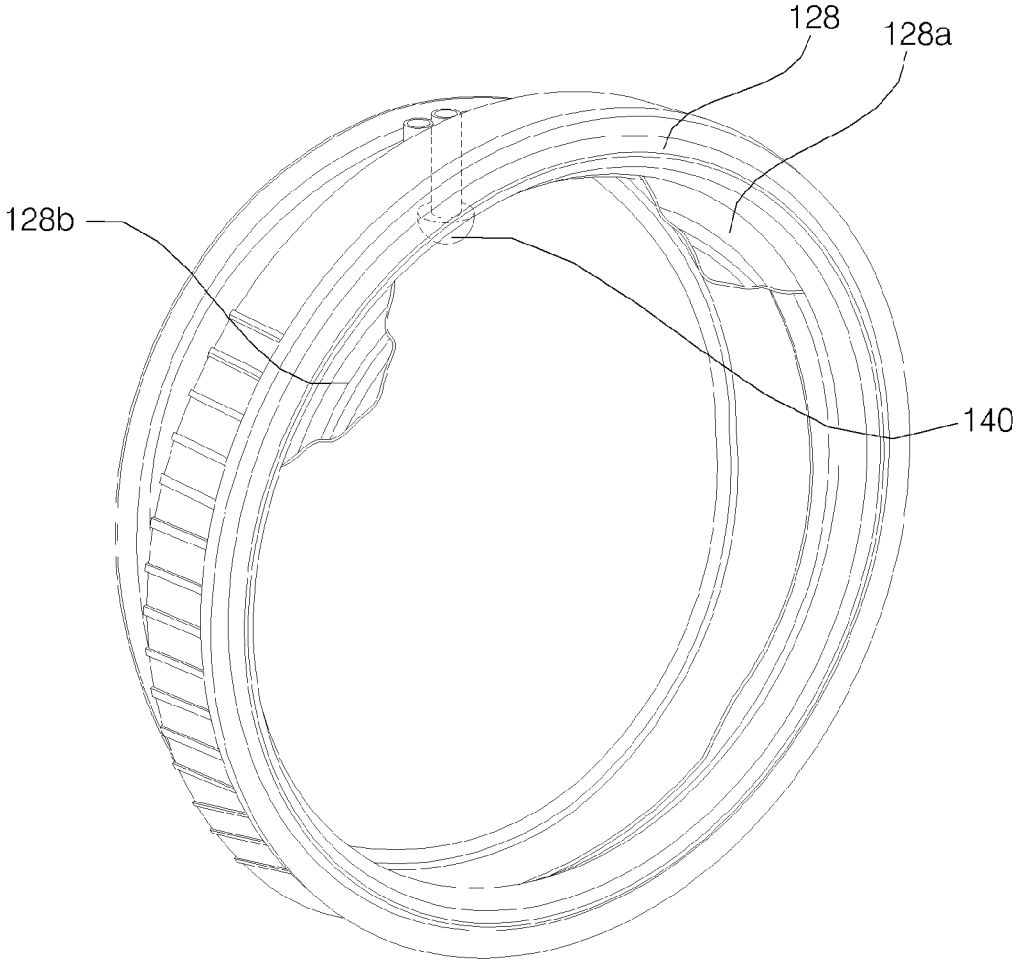
FIG. 5 is a view illustrating a gasket and a spray nozzle of a washing machine according to an embodiment of the present invention.

FIG. 5 is a view illustrating a gasket and an injection nozzle of a washing machine according to an embodiment of the present invention.

Referring to FIG. 5, the gasket 128 may have a first projecting portion 128*a* and a second projecting portion 128*b* formed projecting on an upper portion of an inner side surface thereof, and the spray nozzle 140 may be provided between the first projecting portion 128*a* and the second projecting portion 128*b*. In order to prevent laundry from disengaging and wedging between the gasket 128 and cabinet 111 through the rotation of the drum 124, or laundry from spilling out when the door 112 is opened after washing is complete, the first projecting portion 128*a* and the second projecting portion 128*b* may be formed projecting at the top of the inner side surface of the gasket 128. The first projecting portion 128*a* and the second projecting portion 128*b* may be formed on either side of the gasket 128 at a predetermined gap.

The spray nozzle 140 may be provided between the first projecting portion 128*a* and the second projecting portion 128*b*. The spray nozzle 140 may be provided between the first projecting portion 128*a* and the second projecting portion 128*b* such that the first projecting portion 128*a* and the second projecting portion 128*b* and the wash water are not impeded when wash water is sprayed.

The spray nozzle 140 may be disposed at a position offset from the centerline of the drum 124. When the spray nozzle 140 is positioned offset from the centerline of the drum 124, and when wash water is changed to whirling water and sprayed, the wash water may act upon the entire inner side surface 124*a* of the drum 124 and a portion of the inner rear surface 124*b*, or the wash water may act upon the entire inner side surface 124*a* of the drum 124 and the entire inner rear surface 124*b*.

The spray nozzle 140 may be disposed forming a predetermined angle with an axis perpendicular with the ground surface. According to embodiments, the spray nozzle 140 may be positioned forming a predetermined angle with a centerline of the drum 124 toward the interior of the drum 124. According to other embodiments, the spray nozzle 140 may be positioned forming a predetermined angle with the centerline of the drum 124 offset toward the first projecting portion 128*a* or the second projecting portion 128*b*. According to each embodiment, the spray nozzle 140 may spray wash water upon the entire inner side surface 124*a* of the drum 124 and a portion of the inner rear surface 124*b*, and may spray wash water on the entire inner side surface 124*a* of the drum 124 and the entire inner rear surface 124*b*.

As described above, the position of the spray nozzle 140 is not limited to the present embodiment, and the spray nozzle 140 may be disposed in various positions including the lower portion of the gasket 128, between the gasket 128 and cabinet 111, in the cabinet 111, tub 122, etc.

Figure 6:
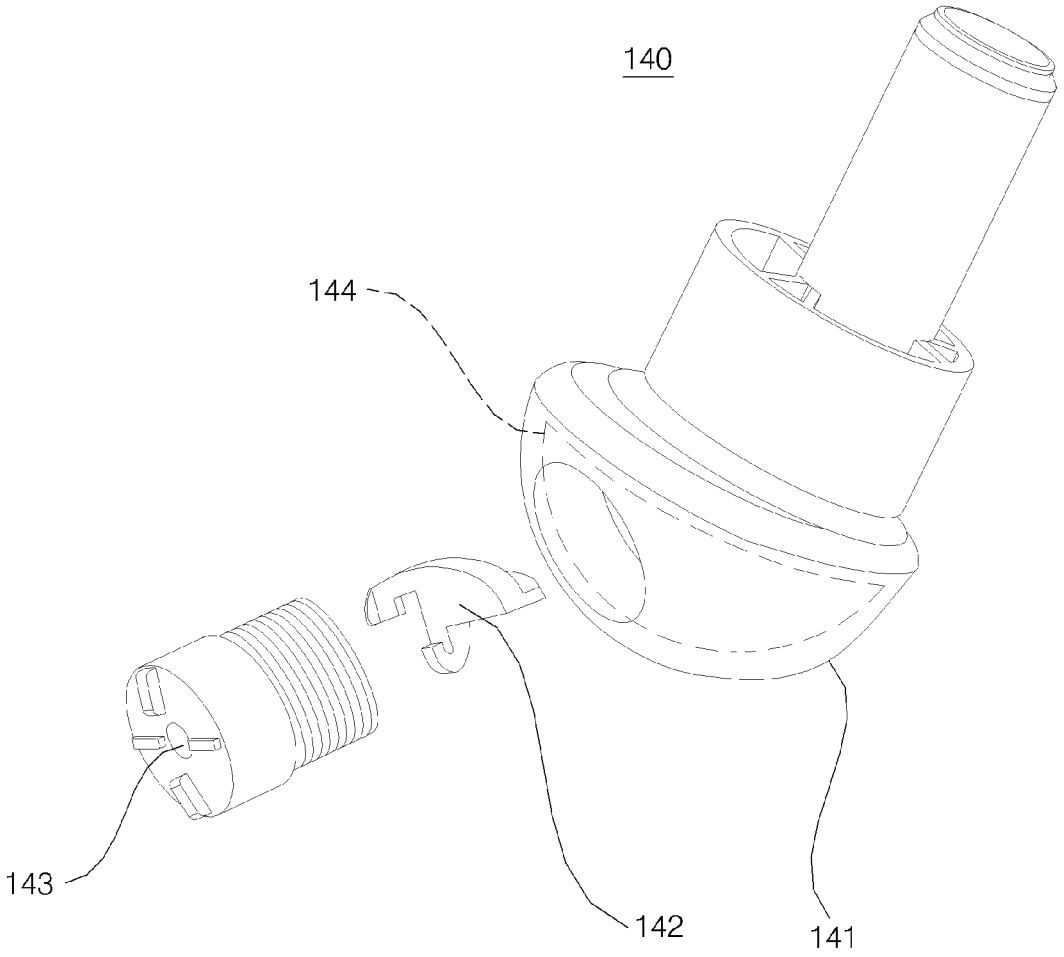
FIG. 6 is an exploded view illustrating a spray nozzle of a washing machine according to an embodiment of the present invention.

FIG. 6 is an exploded view illustrating an injection nozzle of a washing machine according to an embodiment of the present invention.

Referring to FIG. 6, a spray nozzle 140 may have one side formed in a hemispherical shape, to include a dome 141 defining a receiving space 144 within, a core 142 with a plurality of twisted plates formed in the receiving space 144 to form twisted passages together with the receiving space 144, and a spray nozzle cap 143 that sprays wash water passing through the passages defined by the core 142 and the receiving space 144.

In the present embodiment, the spray nozzle 140 may be a whirling nozzle including the dome 141, core 142, and spray nozzle cap 143.

The spray nozzle 140 may be formed in a hemispherical shape on one side. The void that may be the receiving space 144 is defined within the hemispherical shape. The wash water guided by the spray nozzle 140 may be received in the receiving space 144. The one side of the spray nozzle 140 may be formed in a curved configuration of a hemispherical or oval shape. One side of the spray nozzle 140 may be formed in a curved shape, so that when laundry is inserted into the laundry loading hole 120, the laundry is not damaged from catching on the spray nozzle 140 or by the spray nozzle 140.

The core 142 formed with the twisted plate may be provided in the receiving space 144. The core 142 may be formed with one or a plurality of twisted plates. The core 142 may be provided in the receiving space 144, a passage is defined between the receiving space 144 and the core 142, and because the passage is formed in the shape of the twisted plate, a plurality of twisted shapes or screw shapes is formed. The core 142, according to embodiments, may be configured in various shapes formed by the receiving space 144 and twisted passage, and may be configured in various types of formations including screws, propellers, twisted tubes, twisted propellers, twisted screws, screw threads, etc.

When wash water passes through a passage of the core 142 and the receiving space 144, it may be changed to revolving wash water by means of the passage shape. While the core 142 may generally be fixed, when wash water may pass through the passage formed by the core 142 and receiving space 144, the core 142 may be rotated within the receiving space 144 by wash water. When the core 142 is rotated, the wash water may also rotate to promote formation of whirling water.

Upon rotation of the drum 124, the spray nozzle 140 may spray wash water on the entire inner side surface 124*a* of the drum 124 and a portion of the inner rear surface 124*b*, and may spray wash water on the entire inner side surface 124*a* of the drum 124 and the entire inner rear surface 124*b*. The wash water sprayed from the spray nozzle may be sprayed in whirling water, and the wash water may be atomized to be absorbed into and penetrate the laundry quickly.

The spray nozzle cap 143 may spray wash water that passes through the passage formed by the core 142 and receiving space 144. The spray nozzle cap 143 may define an opening to spray wash water changed by the passage to whirling water into the drum 124. The spray nozzle cap 143 may be fastened to the dome 141 and fixed. When the spray nozzle cap 143 is fixed to the dome 141, in order to prevent wash water from leaking out from the coupling portion of the spray nozzle cap 143 and dome 141, a packing (not shown) formed of a waterproof material such as rubber may be additionally provided.

While in the present embodiment, description of the spray nozzle 140 has been limited to a whirling nozzle, it is not limited thereto, and the spray nozzle 140 may be configured in a variety of types of whirling nozzles for revolving and spraying wash water. The spray nozzle 140 may be implemented in various types of whirling nozzles that spray revolving wash water.

Figure 7:
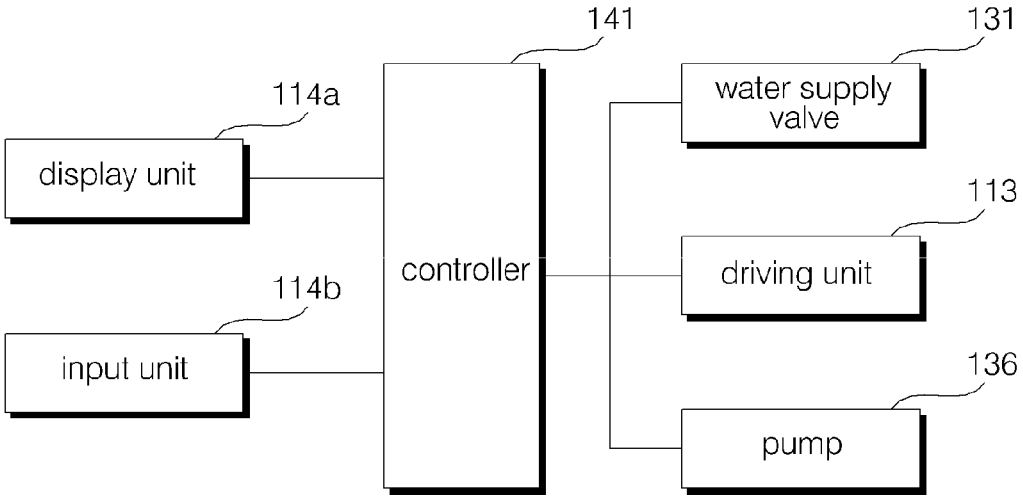
FIG. 7 is a view illustrating a washing machine according to an embodiment of the present invention.

FIG. 7 is a view illustrating a washing machine according to an embodiment of the present invention.

A controller 141 may control overall operations of a washing machine according to an operation command that an input unit 114*b* has received. The controller 141 may be provided in a control panel 114. A Micom and other electronic components for controlling the operation of the washing machine may be provided. The controller 141 may determine whether to perform the respective cycles according to a wash course selected by a user, whether to perform operations such as water supplying, washing, rinsing, draining, spinning and drying, operation time, and the number of cycles.

The controller 141 may control a water supply valve unit 131, a driving unit 113, and a pump 136 according to the selected course or other operating commands.

Figure 8:
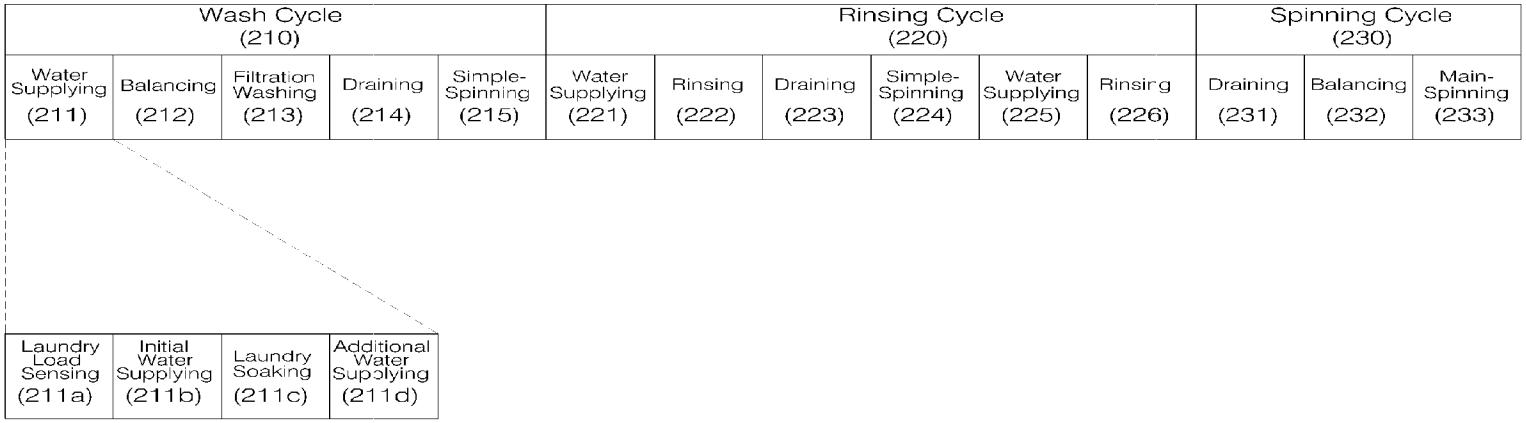
FIG. 8 is a view illustrating the whole cycle of a washing method according to an embodiment of the present invention.

FIG. 8 is a view illustrating the whole cycle of a washing method according to an embodiment of the present invention A wash cycle 210 may be a cycle of removing contaminants from the laundry by rotating a drum 124 after soaking the laundry in wash water mixed with laundry detergent. In the washing method according to the embodiment of the present invention, the wash cycle 210 may progress in the order of water supplying 211, balancing 212, filtration washing 213, draining 214, and simple-spinning 215.

If the wash cycle 210 is initiated, the controller 141 may indicate the wash cycle 210 is initiated by displaying a wash icon on a progress display of a display unit 114*a*.

The water supplying 211 may be supplying wash water from an external water source to a tub 122. A detailed description of the water supplying 211 will be made below.

The balancing 212 may be distributing the laundry by repeating acceleration and deceleration of the drum 124. During the filtration washing 213, the laundry may be biased to one side due to tangle of the laundry, causing unbalancing of the laundry in which one side of the drum 124 is weighted based on the center of the drum 124. Since the unbalancing of the laundry may cause noise and vibration during the filtration washing 213, the balancing 212 may be required to evenly distribute the laundry before the filtration washing 213.

The balancing 212 may include distributing the laundry by repeating acceleration and deceleration of the drum 124 before the filtration washing 213 in a state where wash water is filled in the tub 122. The balancing 212 may be performed by decelerating the drum 124 after accelerating the drum at a rate of about 70 rpm to about 80 rpm at which the laundry is attached to the inner wall of the drum 124. During the balancing 212, the controller 141 may measure the amount of the laundry (hereinafter, referred to as laundry load) held in the drum 124 based on the deceleration time of the drum 124 when the drum 124 is decelerated, and measure an unbalanced degree of the laundry based on a variation of revolutions per minute (RPM) of the drum 124 after the drum 124 is accelerated.

The laundry load may be measured by various methods. In the present embodiment, the laundry load may be measured by a method in which the controller 141 measures deceleration time after the drum 124 is rotated at a certain rate for a certain time. The longer the deceleration time of the drum 124 is, the higher the level of the laundry load is. According to an embodiment, the controller 141 may also measure the acceleration time upon acceleration of the drum 124 to calculate the laundry load.

The unbalanced degree of the laundry may be calculated using a variation with respect to the rate of the drum 124 after the drum 124 is accelerated. The rate of the drum 124 may be measured using a hole sensor, or may be calculated by measuring a current flowing in a motor of the driving unit 113.

The controller 141 may determine whether the unbalance degree of the laundry falls within a tolerance, using a difference between a rate variation and a reference rate variation. The reference rate variation may vary according to the laundry load. The controller 141 may store a table of the unbalanced degree of the laundry with respect to the reference rate variation according to the laundry load.

The controller 141 may accelerate or decelerate the drum 124 according to the unbalanced degree of the laundry. That is, the controller 141 may adjust the degree of accelerating or decelerating the drum 124 according to the unbalanced degree of the laundry. The controller 141 may also halt the drum 124 when the unbalanced degree of the laundry is excessive.

The controller 141 may repeat the acceleration and deceleration of the drum 124 according to the unbalanced degree of the laundry. When the unbalanced degree of the laundry is greater than the tolerance, the controller 141 may keep accelerating and decelerating the drum 124. When the acceleration and deceleration of the drum 124 are continuously repeated because the unbalanced degree of the laundry is greater than the tolerance, the controller 141 may halt the drum 124. That is, when the acceleration and deceleration of the drum 124 are continuously repeated beyond an allowable number of repetitions, the controller 141 may inform the display unit 114*a* of abnormality, and then may halt the drum 124. If the unbalanced degree of the laundry falls within the tolerance, the controller 141 may halt the balancing 212, and then may perform the filtration washing 213. The balancing 212 described above may be omitted.

The filtration washing 213 may be removing contaminants from the laundry when wash water mixed with washing detergent is supplied in the drum 124 and passes through the laundry while the laundry is being attached to the drum 124. During the filtration washing 213, the controller 141 may control the driving unit 113 to rotate the drum 124 such that the laundry is attached to the drum 124, and may drive the pump 136 to circulate the laundry water along a circulation flow path 137. In order to prevent overheat of the driving unit 113 during the filtration washing 214, the controller 141 may halt the driving of the driving unit 113 at an interval of about several seconds or minutes.

Since a physical shock is not applied to the laundry during the filtration washing 213, little damage may be caused to the laundry. Accordingly, the filtration washing 213 may be performed when a user selects a laundry damage prevention key or a laundry damage prevention course through the input unit 114*b*.

During the filtration washing 213, the drum 124 may rotate at a rate of about 1 or more acceleration of gravity (G) such that the laundry may be attached to the inner wall of the drum 124. The drum 124 may rotate at an appropriate rate such that bubbles are not generated too much during the filtration washing 213. During the filtration washing 213, the drum 124 may rotate at a rate of about 150 rpm.

During the filtration washing 213, the pump may operate to allow the wash water mixed with washing detergent in the tub 122 to circulate along the circulation flow path 137 and to be sprayed through a circulation nozzle 127. In this case, the circulation nozzle may be a whirling nozzle. When the amount of the circulating wash water is great, bubbles may be generated too much. Accordingly, the amount of the circulating wash water may fit to such a degree that the circulation is possible.

The draining 214 may be exhausting the wash water in the tub 122 out of the cabinet 111. During the draining 214, the control unit 141 may operate the pump 136 to allow the wash water in the tub 122 to drain away along a drain flow path 138.

The simple-spinning 215 may be rotating the drum 124 at such a high rate that the wash water drains away from the laundry. During the simple-spinning 215, when the controller 141 drives the driving unit 113 to rotate the drum 124 at a high rate, the laundry may be attached to the inner wall of the drum 124, and may be spin-dried by the centrifugal force. In the simple-spinning 215, since it is not necessary to rotate the drum 124 to an extent that the laundry is dried, the drum 124 may rotate at a rate of about 108 rpm that is a rate of an extent that the laundry is attached to the inner wall of the drum 124.

During the simple-spinning 215, the control unit 141 may intermittently operate the pump 136 to allow the wash water in the tub 122 to drain away along the drain flow path 138.

The above-described wash cycle 210, the balancing 212 and the filtration washing 212 may performed as a generate washing according to a washing course or a user's selection.

The washing may be rotating the drum 124 holding the laundry soaked in the wash water mixed with washing detergent. During the washing, the controller 141 may control the driving unit 113 to rotate the drum 124 at various rates and directions. Thus, mechanical forces such as bending and stretching force, frictional force, and impact force may be applied to remove contaminants from the laundry. In the present embodiment, the drum 124 may be rotated in a certain direction at a rate of about 45 rpm, and the laundry in the drum 124 may be lifted by a lifter 125 and may fall. During the washing, the controller 141 may halt the driving of the driving unit 113 at an interval of about several seconds or minutes in order to prevent overheat of the driving unit 113.

Steam may be sprayed into the drum 124 during the washing. During the washing, the controller 141 may operate the pump 136 to allow the wash water to flow into the drum 124 through the circulation nozzle 127 along the circulation flow path 137.

The rinsing cycle 220 may be a cycle in which residual washing detergent is removed from the laundry by rotating the drum 124 after soaking the laundry in wash water mixed with fabric softener. In the washing method according to the embodiment of the present invention, the rinsing cycle 220 may be performed in the order of water supplying 221, rinsing 222, draining 223, simple-spinning 224, water supplying 225, and rinsing 226. In the present embodiment, the rinsing 222 and 226 may be twice repeated, or may not be repeated or may be repeated several times according to embodiments.

If the rinsing cycle 220 is initiated, the controller 141 may indicate the wash cycle 210 is initiated by displaying a rinse icon on the progress display of the display unit 114*a*.

Similarly to the water supplying of the wash cycle 210 described above, the water supplying 221 may be supplying wash water from the external water source to the tub 122. The fabric softener may not be mixed with wash water during the water supplying 221, but may be mixed with wash water during the last water supplying 224 of the rinsing cycle 220 described below.

The rinsing 222 may be rotating the drum 124 containing laundry soaked in wash water. During the rinsing 222, the controller 141 may control the driving unit 113 to rotate the drum 124 at various rates or directions. Thus, mechanical forces such as bending and stretching force, frictional force, and impact force may be applied to the laundry to remove residual washing detergent and contaminants from the laundry. During the rinsing 222, the controller 141 may operate the pump 136 to allow the wash water to circulate along the circulation flow path 137 and flow into the drum 124 through the circulation nozzle 127.

In this case, the circulation nozzle 127 may be a whirling nozzle, and the rinsing 222 may be a filtration rinsing in which wash water is sprayed into the drum 124 in a state where the laundry is attached to the drum 124, and the wash water passes through the laundry to remove residual detergent from the laundry. In this case, the controller 141 may control the driving unit 113 to rotate the drum 124 at a rate of about 150 rpm that is 1G or more such that the laundry is attached to the drum 124.

Similarly to the draining 213 of the wash cycle 210 described above, the draining 223 may be exhausting wash water in the tub 122 out of the cabinet 111.

Similarly to the simple-spinning 214 of the wash cycle 210 described above, the simple-spinning 224 may be rotating the drum 124 at such a high rate that wash water drains away from the laundry.

Similarly to the water supplying 221 described above, the water supplying 225 may be supplying wash water from an external water source to the tub 122 in order to repeat the rinsing 226. During the water supplying 225, the wash water may be mixed with fabric softener in a detergent box 133 to flow into the tub 122.

Similarly to the rinsing 222 described above, the rinsing 226 may be rotating the drum 124 containing the laundry soaked in the wash water. But, the wash water mixed with the fabric softener may be applied to the laundry to soften the laundry during the rinsing 226.

In this case, the circulation nozzle 127 may be a whirling nozzle, and the rinsing 226 may be a filtration rinsing in which wash water mixed with fabric softener is sprayed into the drum 124 in a state where the laundry is attached to the drum 124, and the wash water passes through the laundry to remove residual detergent from the laundry. In this case, the controller 141 may control the driving unit 113 to rotate the drum 124 at a rate of about 150 rpm that is 1G or more such that the laundry is attached to the drum 124.

The spin cycle 230 may be dehydrating the laundry by rotating the drum 124 at a high rate. In the washing method according to the embodiment of the present invention, the spin cycle 230 may include draining 231, balancing 232, and main-spinning 233.

If the spin cycle 230 is initiated, the controller 141 may indicate that the spin cycle 230 is initiated by displaying a spin icon on the progress display of the display unit 114*a*.

Similarly to the draining 214 of the wash cycle 210 or the draining 223 of the rinse cycle 220, the draining 231 may be exhausting wash water in the tub 122 out of the cabinet 111.

The balancing 232 may be distributing the laundry by repeating acceleration and deceleration of the drum 124. During the filtration washing 213 or the rinsing 222, the laundry may be biased to one side due to tangle of the laundry, causing unbalancing of the laundry in which one side of the drum 124 is weighted based on the center of the drum 124. Since the unbalancing of the laundry may cause noise and vibration during the main-spinning 233, the laundry has to be evenly distributed.

During the balancing 232, the controller 141 may measure the laundry load based on the deceleration time of the drum 124 when the drum 124 is decelerated, and measure an unbalanced degree of the laundry based on a variation of RPM of the drum 124 after the drum 124 is accelerated.

The laundry load may be calculated by measuring a deceleration time when the controller 141 decelerates the drum 124 as described above. The longer the deceleration time of the drum 124 is, the higher the level of the laundry load is. According to an embodiment, the controller 141 may also measure the acceleration time upon acceleration of the drum 124 to calculate the laundry load.

The unbalanced degree of the laundry may be calculated using a variation with respect to the rate of the drum 124 after the drum 124 is accelerated. The rate of the drum 124 may be measured using a hole sensor, or may be calculated by measuring a current flowing in a motor of the driving unit 113.

The controller 141 may determine whether the unbalance degree of the laundry falls within a tolerance, using a difference between a rate variation and a reference rate variation. The reference rate variation may vary according to the laundry load. The controller 141 may store a table of the unbalanced degree of the laundry with respect to the reference rate variation according to the laundry load.

The controller 141 may accelerate or decelerate the drum 124 according to the unbalanced degree of the laundry. That is, the controller 141 may adjust the degree of accelerating or decelerating the drum 124 according to the unbalanced degree of the laundry. The controller 141 may also halt the drum 124 when the unbalanced degree of the laundry is excessive.

The controller 141 may repeat the acceleration and deceleration of the drum 124 according to the unbalanced degree of the laundry. When the unbalanced degree of the laundry is greater than the tolerance, the controller 141 may keep accelerating and decelerating the drum 124. When the acceleration and deceleration of the drum 124 are continuously repeated because the unbalanced degree of the laundry is greater than the tolerance, the controller 141 may halt the drum 124. That is, when the acceleration and deceleration of the drum 124 are continuously repeated beyond an allowable number of repetitions, the controller 141 may inform the display unit 114*a* of abnormality, and then may halt the drum 124. If the unbalanced degree of the laundry falls within the tolerance, the controller 141 may halt the balancing 232, and then may perform the filtration washing 233.

The main-spinning 233 may be rotating the drum 124 at such a high rate that the wash water drains away from the laundry. During main-spinning 233, when the controller 141 rotates the drum 124 at a high rate, the laundry may be attached to the inner wall of the drum 124, and may be spin-dried by the centrifugal force. In the main-spinning 233, the drum 124 may rotate at a rate of about 1,000 rpm or more that is greater than that of the simple-spinning 224 of the rinsing cycle 220.

During the main-spinning 233, the control unit 141 may intermittently operate the pump 136 to allow the wash water in the tub 122 to drain away along the drain flow path 138. After the main-spinning 233, drying may be performed to dry the laundry, by supplying hot air into the drum 124.

The water supplying 211 described above may include laundry load sensing 211*a*, initial water supplying 211*b*, laundry soaking 211*c*, and additional water supplying 211*d*.

The laundry load sensing 211*a* may be sensing the laundry load. As described above, the laundry load sensing may be performed by a method in which the controller 141 measures a deceleration time after the driving unit 113 rotates the drum at a certain rate for a certain time. The longer the deceleration time of the drum 124 is, the higher the level of the laundry load is. According to an embodiment, the controller 141 may also calculate the laundry load by measuring an acceleration time when the drum 124 is accelerated. The controller 141 may determine the amount of wash water that is supplied into the tub 122 during the initial water supplying 211*b* and the additional water supplying 211*d*, and then may determine operation times for each cycles.

The initial water supplying may be supplying wash water mixed with washing detergent into the tub 122, and spaying wash water without washing detergent into the drum 124. During the initial water supplying 211*b*, while opening a first water supply valve 131*a* and a second water supply valve 131*b*, the controller 141 may supply wash water mixed with washing detergent into the tub 122, and may spray wash water without washing detergent into the drum 124 through a spray nozzle 140.

When the control unit 141 opens the first water supply valve 131*a*, a portion of wash water supplied from an external water supply may flow into the detergent box 133 through a first water supply hose 132. The wash water may be mixed with the washing detergent in the detergent box 133 to flow into the tub 122 through a water supply pipe 134. The wash water may also be mixed with bleach in the detergent box 133.

When the control unit 141 opens the second water supply valve 131*b*, the other portion of wash water supplied from the external water supplied may pass through a second water supply hose 149 and then may be sprayed into the drum 124 at the spray nozzle 140. In this case, the spray nozzle 140 may be a whirling nozzle, and may generate whirling water to allow the wash water to be sprayed on the inner side surface 124*a* and the inner rear surface 124*b* of the drum 124.

The initial water supplying 211*b* may performed until wash water is filled up to a target water level. The target water level may be determined by the controller 141 according to a measured laundry load or a selected course prior to the initial water supplying 211*b*. In the present embodiment, the target water level may be filled up to an extent that the wash water is slightly over the drum 124. Since the laundry is evenly soaked by the wash water sprayed from the spray nozzle 140, the water level may not be lowered due to soaking of the laundry in the wash water during the laundry soaking 211*c*. Accordingly, the target water level at which the wash water can be circulated during the laundry soaking 211*c* may be sufficient.

During the initial water supplying 211*b*, the water level of wash water may be measured by a water level sensing device (not shown). If wash water flows into the tub 122 up to the target water level, the controller 141 may block the first water supply valve 131*a* and the second water supply valve 131*b* to finish the initial water supplying 211*b*.

The laundry soaking 211*c* may be that the controller 141 drives the driving unit 113 to rotate the drum 124 such that the laundry is evenly soaked in wash water mixed with washing detergent, and the washing detergent is dissolved. During the laundry soaking 211*c*, the controller 141 may operate the pump 136 to allow wash water to circulate along the circulation flow path 137 and flow into the drum 124 through the circulation nozzle 127.

In this case, the circulation nozzle 127 may be a whirling nozzle, and the circulation nozzle 127 may generate whirling water to allow the wash water to be sprayed on the inner side surface 124*a* and the inner rear surface 124*b* of the drum 124

The additional water supplying 211*d* may be additionally supplying wash water into the tub 122 up to the target water level because the water level is lowered below the target water level due to soaking of the laundry in wash water. During the addition water supplying 211*d*, the controller 141 may open the first water supply valve 131*a* or the second water supply valve 131*b* to supply wash water into the tub 122 through the water supply pipe 134 or spray wash water into the drum 124 through the spray nozzle 140. In this case, the spray nozzle 140 may be a whirling nozzle, and may generate whirling water to allow wash water to be sprayed on the inner side surface 124*a* and the inner rear surface 124*b* of the drum 124.

When the laundry is sufficiently soaked during the initial water supplying 211*b*, the water level may not be lowered during the laundry soaking 211*c*. Accordingly, the additional water supplying 211*d* may be omitted.

Each step of the water supply 211 described above may be applied to the water supplying 221 and 225 of the rinse cycle 220. In the water supplying 221 and 225 of the rinse cycle 220, the laundry load sensing 211*a* may be omitted, and wash water mixed with fabric softer, not washing detergent, may be supplied during the initial water supplying 211*b*.

Also in the water supplying 221 and 225 of the rinse cycle 220, the circulation nozzle or the spray nozzle 140 that is a whirling nozzle may generate whirling water to allow wash water to be sprayed on the inner side surface 124*a* and the inner rear surface 124*b* of the drum 124.

Figure 9:
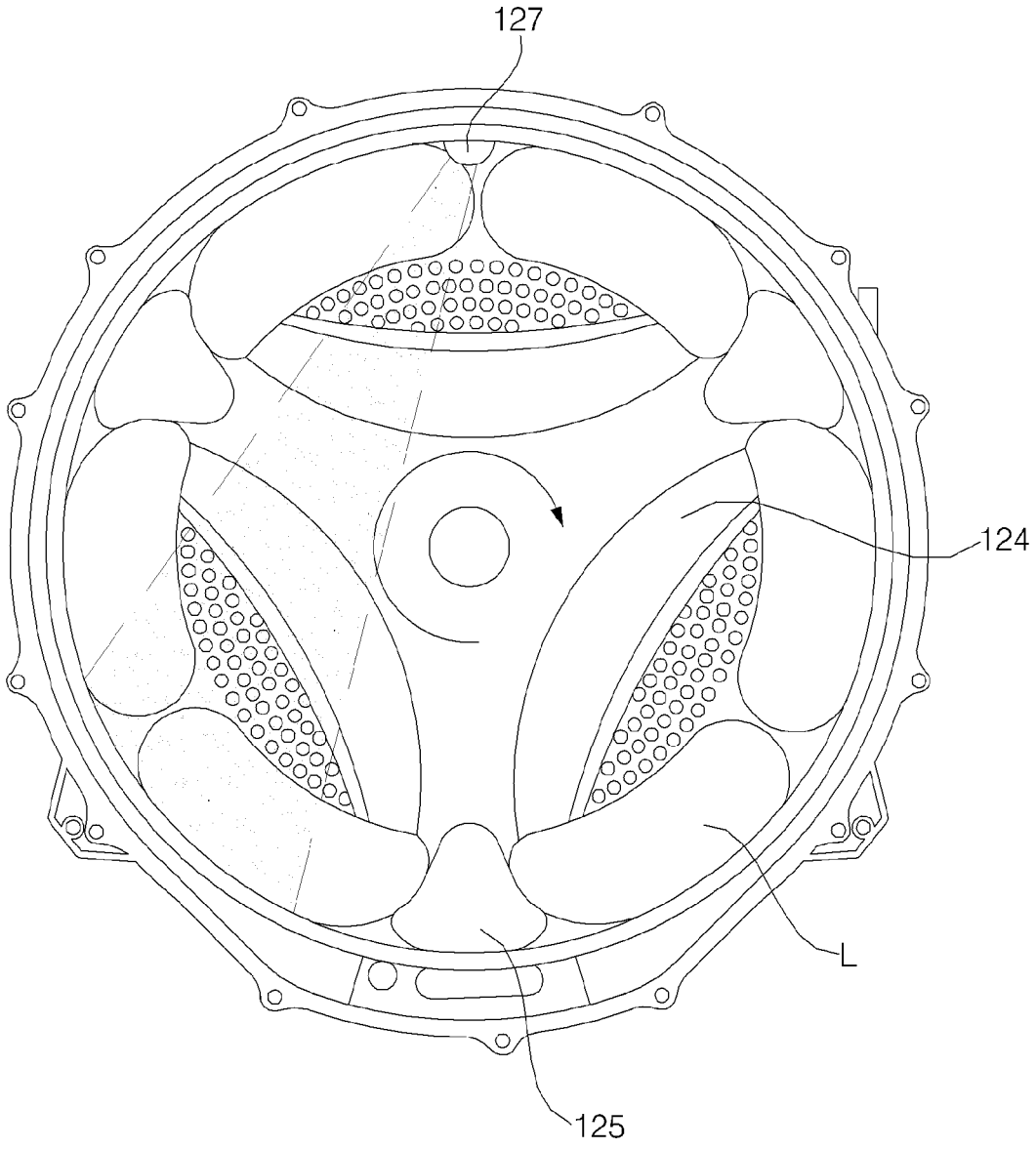
FIG. 9 is a view illustrating a filtration washing performed by a washing machine according to an embodiment of the present invention.

FIG. 9 is a view illustrating a filtration washing performed by a washing machine according to an embodiment of the present invention.

Referring to FIG. 9, when the drum 124 rotates such that the laundry is attached to the drum 124 during the filtration washing 213, wash water may be circulated along the circulation flow path 137 to be sprayed through the circulation nozzle 127.

The drum 124 may rotate at a rate of about 150 rpm, and the circulation nozzle 127 may spray wash water into the drum 124.

Figure 10:
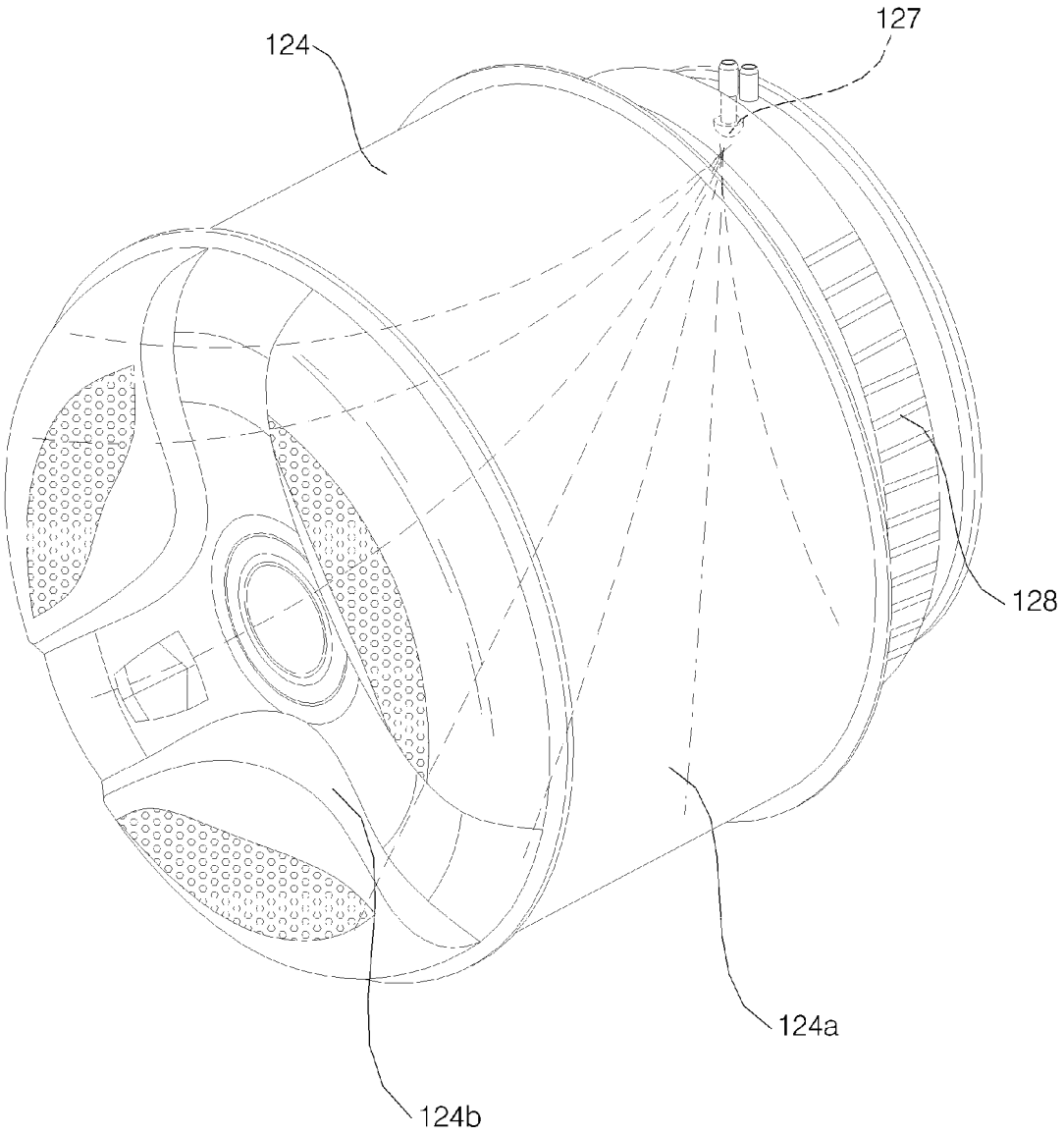
FIG. 10 is a view illustrating a circulation nozzle of a washing machine according to an embodiment of the present invention sprays wash water into a drum.

FIG. 10 is a view illustrating a circulation nozzle of a washing machine according to an embodiment of the present invention sprays wash water into a drum.

Referring to FIG. 10, the circulation nozzle 127 may allow wash water to be sprayed on the inner side surface 124*a* and the inner rear surface 124*b* of the drum 124. The wash water sprayed from the circulation nozzle 127 may reach the inner side surface 124*a* of the drum 124 corresponding to the circumferential surface of the drum 124, and the inner rear surface 124*b* corresponding to the bottom surface of the drum 124.

The circulation nozzle 127 may spray wash water on the whole of the inner side surface 124*a* and a portion of the inner rear surface 124*b*, preferably, the whole of the inner side surface 124*a* and the whole of the inner rear surface 124*b* of the drum 124.

In the present embodiment, the circulation nozzle 127, which is a whirling nozzle that revolves wash water to discharge, may change wash water into whirling water such that wash water performs a translational motion and a circular motion.

Due to a centrifugal force by the whirling water, the wash water may be distributed to be sprayed on the inner side surface 124*a* and the inner rear surface 124*b* of the drum 124. Also, due to the centrifugal force by the whirling water, the wash water may be atomized to be rapidly absorbed into the laundry, and may pass through the laundry.

The circulation nozzle 127 may be provided at an upper portion of the gasket 128. According to embodiments, the circulation nozzle 127 may be disposed at various positions such as a lower portion of the gasket 128, the cabinet 111, and the tub 122, or between the gasket 128 and the cabinet 111.

Also, the circulation nozzle 127 may be provided between a first protrusion 128*a* and a second protrusion 128*b* of the gasket 128.

Figure 11:
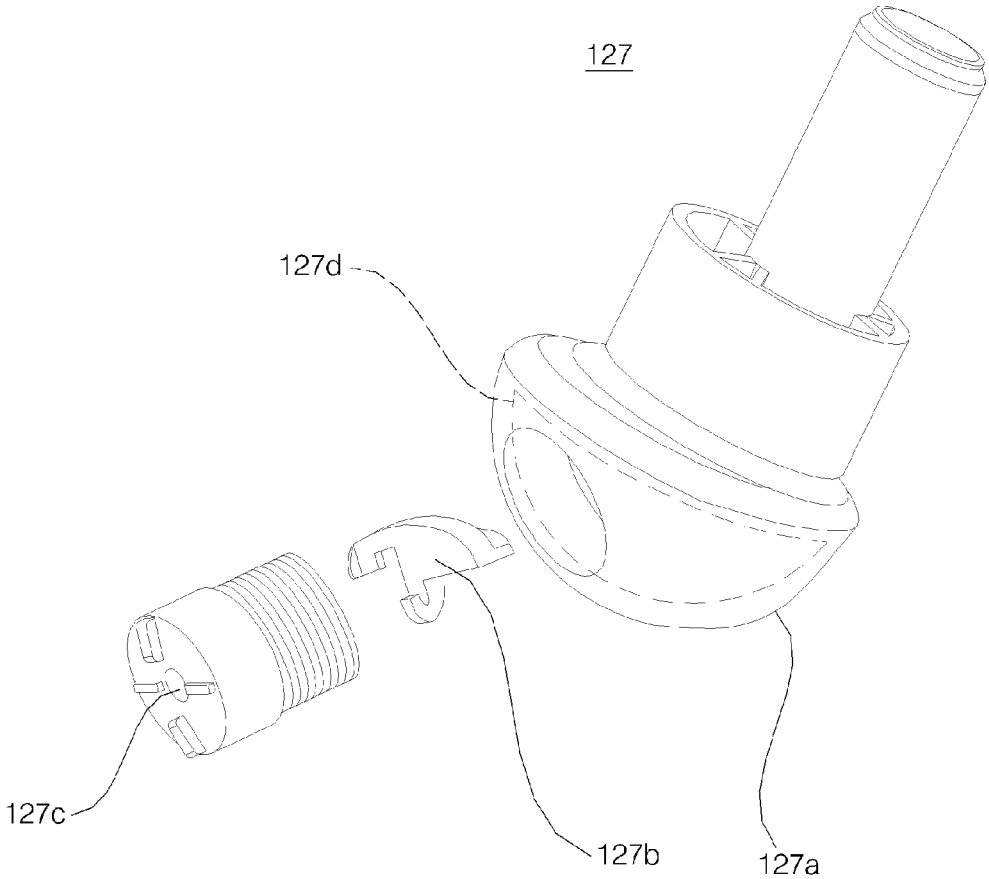
FIG. 11 is an exploded view illustrating a circulation nozzle of a washing machine according to an embodiment of the present invention.

FIG. 11 is an exploded view illustrating a circulation nozzle of a washing machine according to an embodiment of the present invention.

Referring to FIG. 11, the circulation nozzle 127 may include a dome 127*a* having a hemispherical shape at one side thereof and having a receiving space 127*d* therein, a core 127*b* disposed in the receiving space 127*d* and having a twisted plate-shape to form a plurality of twisted flow paths together with the receiving space 127*d* to change wash water passing therethrough into whirling water, and a spray nozzle cap 127 from which the wash water passing through the flow path formed by the core 127*b* and the receiving space 127*d* is sprayed. A nozzle including the dome 141, the core 142, and the spray nozzle cap 143 described above may be a whirling nozzle. In the present embodiment, the circulation nozzle 127 may be a whirling nozzle.

In the present embodiment, the circulation nozzle 127 may be a whirling nozzle including a dome 127*a*, a core 127*b*, and a spray nozzle cap 127*c*.

The circulation nozzle 127 may be formed to have a hemispherical shape at one side thereof. The receiving space 127*d* that is an empty space may be formed with the hemispherical shape. The wash water flowing in the circulation nozzle 127 may be held in the receiving space 127*d*. One side of the circulation nozzle 127 may be formed to have a curved shape forming a hemisphere or an oval. Since one side of the circulation nozzle 127 is formed to have a curved shape, the laundry may not be caught on the circulation nozzle 127 or may not be damaged by the circulation nozzle 127 when the laundry goes in and out through the laundry loading hole 120.

The receiving space 127*d* may be provided with the core 127*b* formed of a twisted plate. The core 127*b* may be formed to have a shape in which one or more plates are twisted. The core 127*b* may be provided in the receiving space 127*d* to form a flow path between the receiving space 127*d* and the core 127*b*. The flow path may be formed to have a plurality of twisted shapes or a spiral shape as the core 127*b* is formed to have a shape of twisted plate. The core 127*b* may be implemented in various shapes forming a twisted flow path together with the receiving space 127*d* according to embodiments, and may be implemented in various shapes such as screw, propeller, twisted tube, twisted propeller, twisted screw, and screw thread.

When passing through the flow path between the core 127*b* and the receiving space 127*d*, wash water may be revolved by the shape of the flow path to be changed to whirling water. The core 127*b* may be typically fixed, but may be rotated in the receiving space 127*d* by wash water when the wash water passes through the flow path formed between the core 127*b* and the receiving space 127*d*. As the core 127 rotates, wash water may be together rotated to promote formation of whirling water.

During the rotation of the drum 124, the circulation nozzle 127 may spray wash water on the whole of the inner side surface 124*a* and a portion of the inner rear surface 124*b* of the drum 124, preferably, the whole of the inner side surface 124*a* and the whole of the inner rear surface 124*b* of the drum 124. Also, since wash water is sprayed in whirling water from the circulation nozzle 127, the wash water may be atomized to be quickly absorbed into the laundry and pass through the laundry.

The spray nozzle cap 127*c* may allow wash water having passed through the flow path between the core 127*b* and the receiving space 127*d* to be sprayed. The spray nozzle cap 127*c* may allow wash water changed to whirling water to be sprayed through an opening. The spray nozzle cap 127*c* may be coupled and fixed to the dome 127*a*. When the spray nozzle cap 127*c* is coupled to the dome 127*a*, a packing (not shown) formed of water-resistant material such as rubber may be additionally provided such that wash water is not leaked at a portion where the spray nozzle cap 127*c* is coupled to the dome 127*a*.

In the present embodiment, the circulation nozzle 127 has been described as a whirling nozzle, but embodiments are not limited thereto. For example, the circulation nozzle 127 may be implemented with various whirling nozzles spraying revolving wash water.

Figure 12:
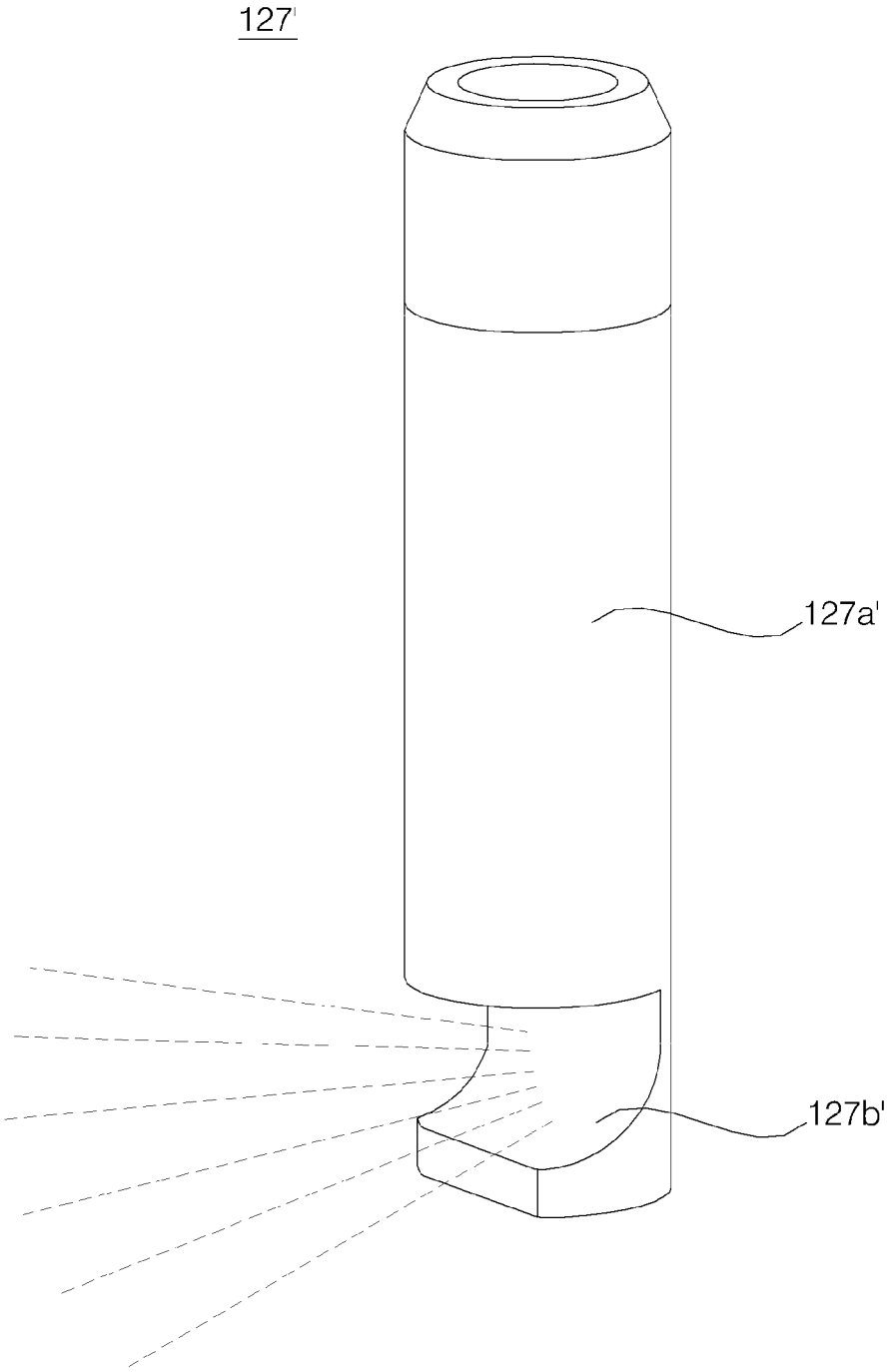
FIG. 12 is a perspective view illustrating a circulation nozzle of a washing machine according to another embodiment of the present invention.

FIG. 12 is a perspective view illustrating a circulation nozzle of a washing machine according to another embodiment of the present invention.

Referring to FIG. 12, a circulation nozzle 127' may include a main body 127*a*' having a flow path through which wash water passes, and a bent surface 127*b*' which wash water having passed the main body 127*a*' runs against and is bent to be sprayed from.

The main body 127*a*' may be formed to have a cylindrical shape to pass wash water. The bent surface 127*b*' may be extended from an opening of the lower side of the main body 127*a*' to form an arc shape.

If wash water may run against the bent surface 127*b*' through the flow path of the main body 127*a*', the wash water may be evenly sprayed over the drum 124. Accordingly more wash water may pass through the laundry.

Similarly to the circulation nozzle 127', the spray nozzle 140 may include a main body (not shown) having a flow path through which wash water passes, and a bent surface (not shown) which wash water having passed the main body 140*a*' runs against and is sprayed from.

Figure 13:
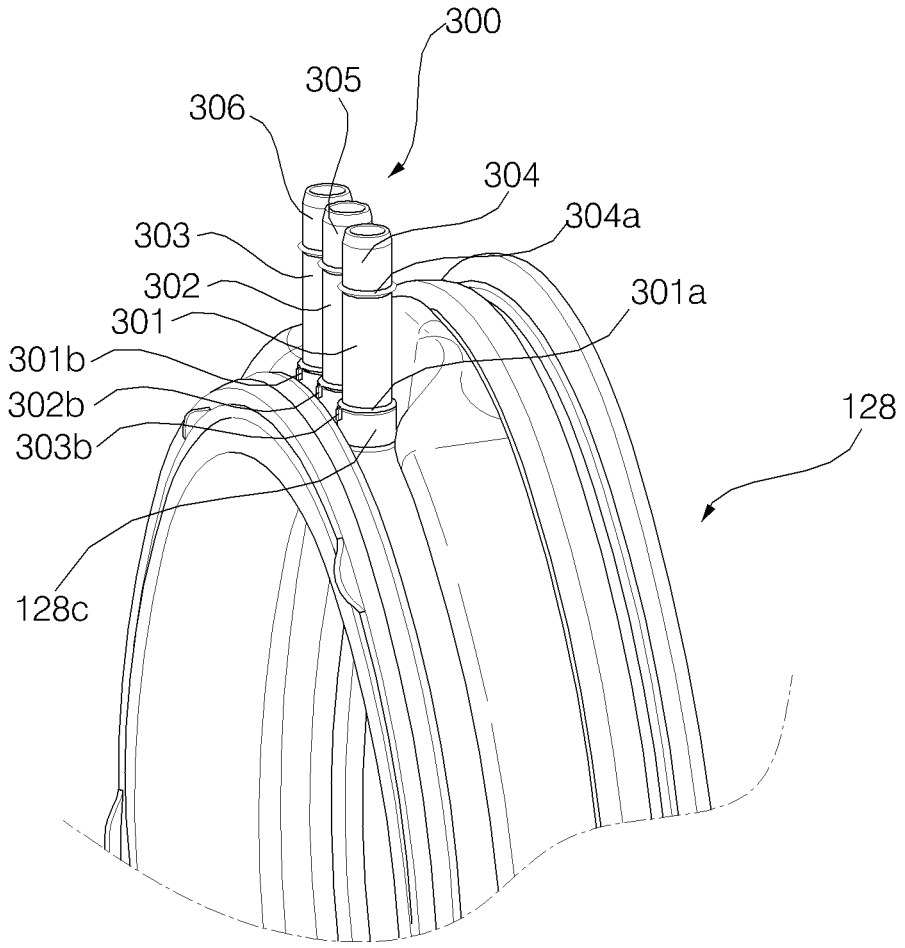
FIG. 13 is a view illustrating a gasket and a nozzle of a washing machine according to still another embodiment of the present invention.
Figure 14:
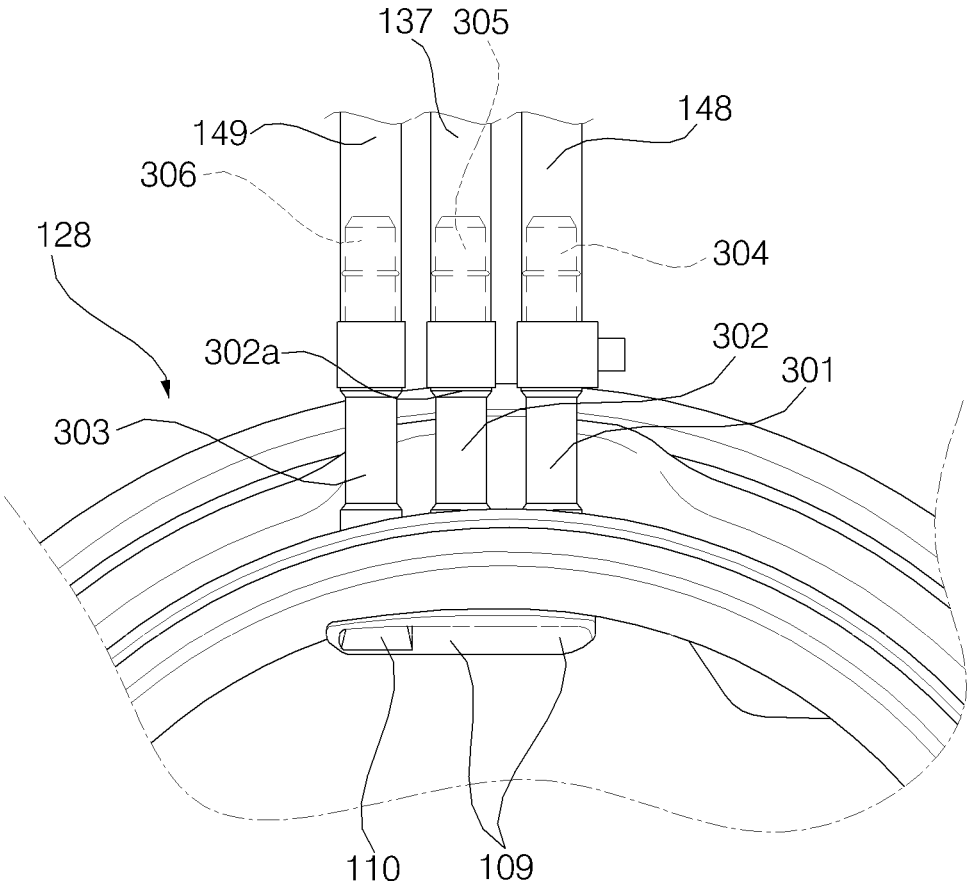
FIG. 14 is a front view illustrating the nozzle device of FIG. 13.
Figure 15:
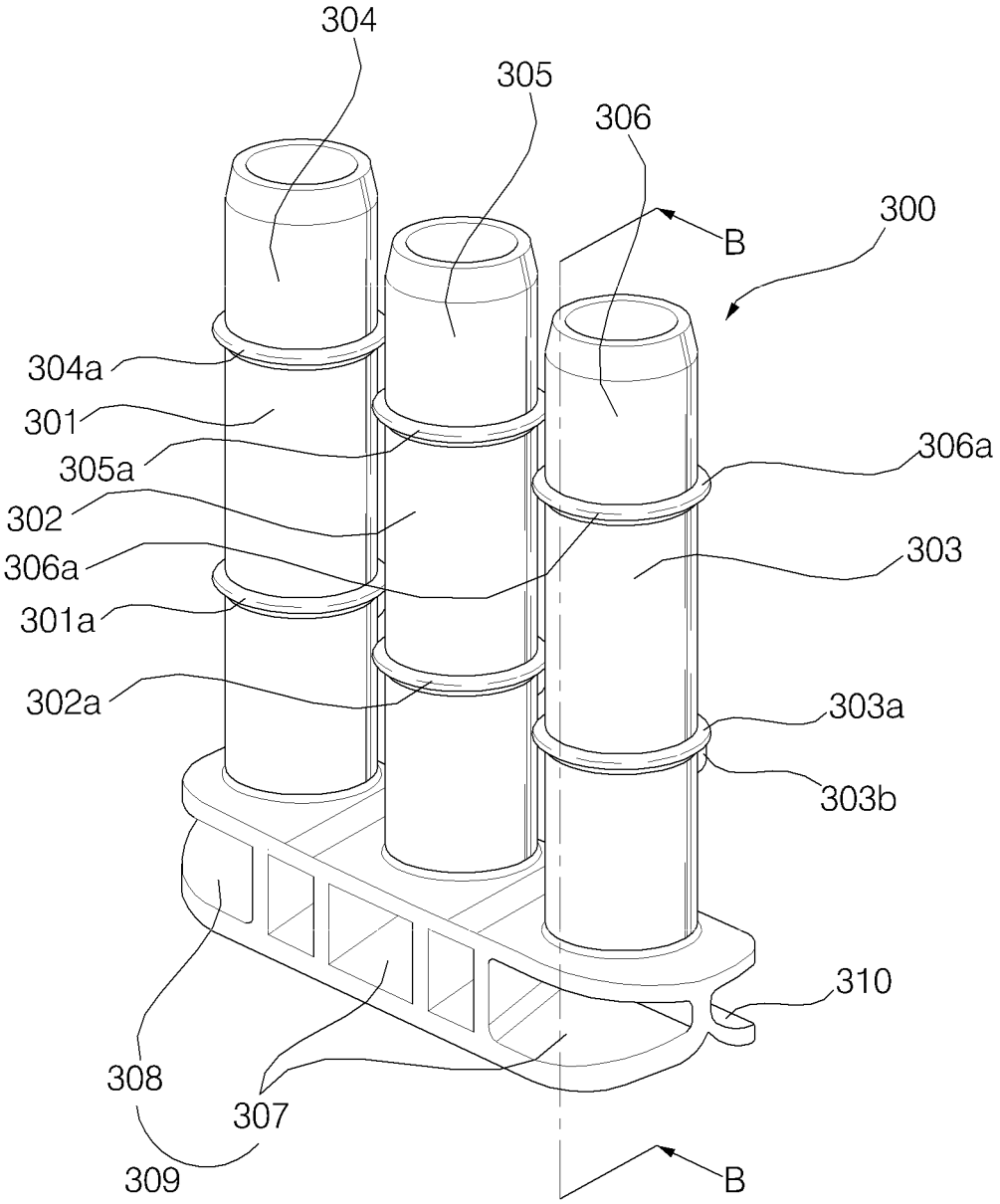
FIG. 15 is a perspective view illustrating the nozzle device of FIG. 13.
Figure 16:
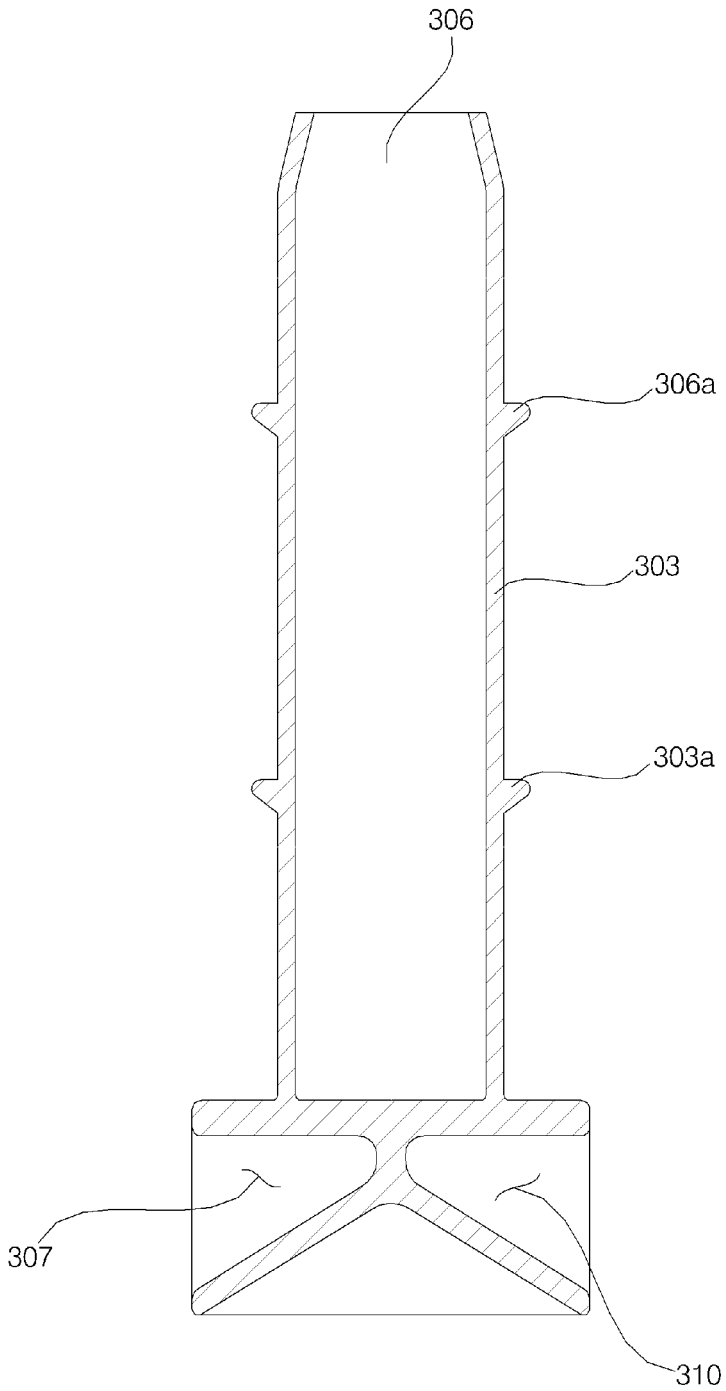
FIG. 16 is a cross-sectional view illustrating the nozzle device of FIG. 13.

FIG. 13 is a view illustrating a gasket and a nozzle of a washing machine according to still another embodiment of the present invention. FIG. 14 is a front view illustrating the nozzle device of FIG. 13. FIG. 15 is a perspective view illustrating the nozzle device of FIG. 13.

A steam hose 148 guiding steam into the drum 124, a circulation flow path 137, and a second water supply hose 149 are coupled to a gasket 128 of a washing machine 100 according to still another embodiment of the present invention. A nozzle device 300 may be provided to spray steam and wash water supplied through the steam hose 148, the circulation flow path 137, and the second water supplying hose 149.

A boss portion 128*c* may be protruded from an upper portion of the gasket 128 such that the nozzle device 300 is connected to the gasket 128. The connecting nozzle device 300 may be disposed to pass through the boss portion 128*c*.

The connecting nozzle device 300 may include a plurality of cylindrical portions 301, 302 and 303 formed to be exposed to the upper portion of the gasket 128 through the boss portion 128*c* when installed at the gasket 128, a plurality of hose coupling portions 304, 305 and 306 formed to be coupled to the steam hose 148, the circulation flow path 137 and the second water supply hose 149, and a plurality of nozzle portions 309 provided to connect all of the lower ends of the plurality of the cylindrical portions 301, 302 and 303 and spray wash water and/or steam into the gasket 128.

The cylindrical portions 301, 302 and 303, the hose coupling portions 304, 305 and 306, and the nozzle portions 309 may be individually provided. In the present embodiment, the hose coupling portions 304, 305 and 306 may be provided to allow the steam hose 148, the circulation flow path 137, and the second water supply hose 149 to be coupled thereto as described above.

A plurality of hook portions 301*a*, 302*a* and 303*a* may be formed on the plurality of cylindrical portion 301, 302 and 303 to promote downward coupling at the upper portion of the gasket 128, respectively. The hooking portions 301*a*, 302*a* and 303*a* may be ribs that are radially protruded along the circumferential surface of the cylindrical portions 301, 302 and 303.

Also, fitting protrusions 303*b* protruding a radial direction to the gasket 128 may be formed on the plurality of cylindrical portions 301, 302 and 303, respectively. A fitting holes (not shown) to which the fitting protrusions 303*b* are fitted may be formed on the boss portion 128*c* of the gasket 128.

The plurality of hose coupling portions 304, 305 and 306 may be formed to extend from the cylindrical portions 301, 302 and 303 in the longitudinal direction such that the hose coupling portion 304, 305 and 306 protrude from the outer circumferential surface of the gasket 128. The guide ribs 304*a*, 305*a* and 306*a* may be formed to guide coupling positions of the steam hose 148, the circulation flow path 137, and the second water supply hose 149.

The guide ribs 304*a*, 305*a* and 306*a* may radially protrude along the circumferential direction from the circumferential surface of the hose coupling portions 304, 305 and 306 similarly to the hooking portions 301*a*, 302*a* and 303*a*, and may be formed at a further outer side than the outer circumferential surface of the gasket 128.

The steam hose 148, the circulation flow path 137, and the second water supply hose 149 may be fixedly coupled to a clamp 304, respectively, after fitted to the plurality of hose coupling portions 304, 305 and 306.

The plurality of nozzle portions 309 may include a drum spray portion 307 formed to have a gradually extended width directly under the respective cylindrical portions 302 and 303 to which the circulation flow path 137 and the second water supply hose 149 are coupled and downwardly inclined to the drum 124 disposed at the rear portion, and a steam spray portion 308 disposed directly under the cylindrical portion 301 to which the steam hose 148 is connected, and formed to be opened to the drum 124 disposed at the rear portion. The drum spray portion 307 may include a spray nozzle 140 spraying wash water supplied from an external water source through the second water supply hose 149 into the drum 124, and a circulation nozzle 127 spraying wash water circulating through the circulation flow path 137 into the drum 124. That is, the drum spray portion 307 formed directly under the cylindrical portion 302 to which the circulation flow path 137 is connected may correspond to the circulation nozzle 127, and the drum spray portion 307 formed directly under the cylindrical portion 302 to which the second water supply hose 149 is connected may correspond to the spray nozzle 340.

Also, the connecting nozzle device 300 may include a door spray portion 310 disposed directly under the cylindrical portion 303 to which the second water supply hose 149 is connected, and connected to the second water supply hose 149 to spray wash water to the front side at which the door 112 is disposed.

The door spray portion 310 need not to be disposed directly under the cylindrical portion 303 to which the second water supply hose 149 is connected, rather may be disposed directly under the cylindrical portion 302 to which the circulation flow path 137 is connected. That is, the door spray portion 310 may be disposed in at least one of the circulation nozzle 127 and the spray nozzle 140.

The door spray portion 310 may spray wash water on the inner side surface of the door 112 to clean the inner side surface of the door 112 such that contaminant, washing detergent, or fabric softener is not stuck on the inner side surface of the door 112.

The door spray portion 310 may be integrally formed in the connecting nozzle device 300. The door spray portion 310 may be disposed directly under the cylindrical portions 302 and 303 to which the circulation flow path 137 or the second water supply hose 149 is connected, may be opened toward the door 112, and may be downwardly inclined such that its width is gradually extended. The door spray portion 310 may be formed adjacent to the drum spray portion 307, and may be formed to face the drum spray portion 307 based on the central undersurface of the cylindrical portion 302 and 303. That is, the door spray portion 310 may be formed to adjacently face the circulation nozzle 127 or the spray nozzle 140.

Thus, when the door spray portion 310 is integrally formed in the connecting nozzle device 300, wash water from the drum spray portion 307 may be sprayed on the laundry in the drum 124 such that the laundry is evenly soaked by the wash water, and wash water from the door spray portion 310 may be evenly sprayed on the inner side surface of the door 312.

Here, the door spray portion 310 may be disposed such that wash water is evenly sprayed on the whole of the inner side surface of the door 112. However, when the supply pressure of wash water supplied from the door spray portion 310 is low, even spraying on the whole of the inner side surface of the door 112 may be difficult. In this case, the door spray portion 310 may be disposed such that wash water may be sprayed in an oblique direction toward the upper end portion of the inner side surface of the door 112. When wash water is sprayed from the door spray portion 310 to the upper end portion of the inner side surface of the door 112, the sprayed wash water may stream down from the upper end portion of the inner side surface of the door 112 to evenly wash the inner side surface of the door 112.

Figure 17:
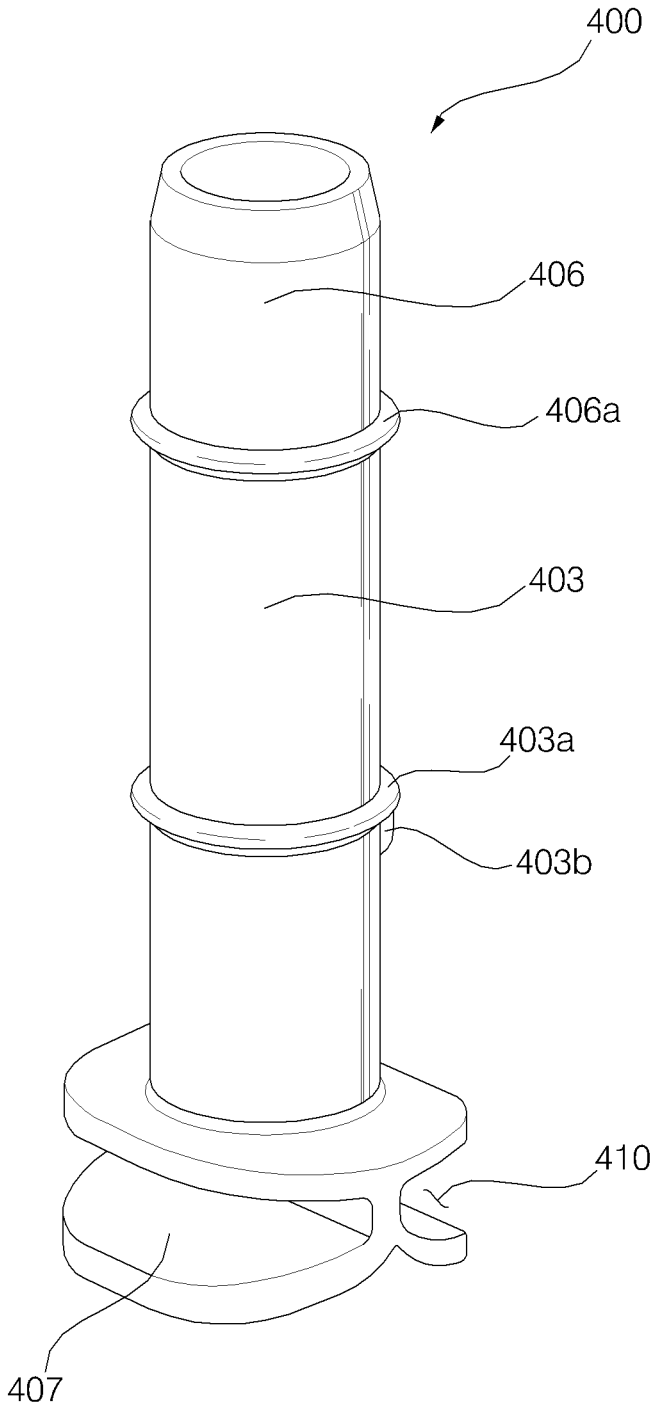
FIG. 17 is a view illustrating a nozzle of a washing machine according to still another embodiment of the present invention.

FIG. 17 is a view illustrating a nozzle of a washing machine according to still another embodiment of the present invention.

A door spray portion 410 according to still another embodiment of the present invention may be formed in a nozzle 400 separated from the connecting nozzle device 300.

Also, in the nozzle 400 separated from the connecting nozzle device 300, one of the circulation flow path 137 or the second water supply hose 149 may be directly connected to the hose coupling portion 406 corresponding to an upper portion of the door spray portion 410.

However, the nozzle 400 may not necessarily have only the door spray portion 410 opened toward only the door 112. That is, the nozzle 400 may correspond to the circulation nozzle 127 or preferably, the spray nozzle 140 that spray wash water to the drum 124.

Also, a door spray portion 410 may be formed in the circulation nozzle 127 shown in FIGS. 9 through 12 or the spray nozzle 140 shown in FIGS. 4 through 6. In this case, when the circulation nozzle 127 or the spray nozzle 140 is a whirling nozzle, the door spray portion 410 may be formed at the opposite sides to the locations where the cores 142 and 127*b* are provided in the domes 141 and 127*a*. The door spray portion 410 may be formed in the spray nozzle 140.

Reference numerals 403*a* and 403*b* that have not been described may be a hooking portion and a fitting protrusion that perform a function similar to that of the connection nozzle device 300 according to an embodiment, and reference numeral 406*a* may be a guide rib that performs a function similar to that of the connecting nozzle device 300 according to an embodiment.

When wash water is supplied in such a way, the wash water may be sprayed to the drum 124 by the circulation nozzle 127 or the spray nozzle 140. Also, since the wash water is sprayed to the door 112 by the door spray portion 410, water supplying and door cleaning may be performed.

An action on the door spray portion 310 described above will be described in detail as follow.

The door spray portion 310 may spray wash water on the door 112A to maintain the inner side surface of the door 112 in a clean condition. The door cleaning process may be performed for a certain time after the water supplying 211 of the wash cycle 210 of supplying wash water mixed with washing detergent, and/or after the water supplying 225 of the rinse cycle 220 of supplying wash water mixed with fabric softener. Alternatively, the door cleaning process may be performed for a certain time before the draining 214 after the filtration washing 213 of the wash cycle 210, and/or before the draining 231 of the spin cycle 230 after the rinsing 226 of the rinse cycle 220.

The door cleaning process may be separately performed before the balancing 212 after the water supplying 211 is completed, but may be performed during the water supplying 211. That is, the door cleaning process may be performed during the initial water supplying 211*b* or the additional water supplying 211*d* of the water supplying 211. Particularly, when the door spray portion 310 is formed in the spray nozzle 140, and during the initial water supplying 211*b* and the additional water supplying 211*d*, the spray nozzle 140 sprays wash water supplied from an external water source into the drum 124, the door spray portion 310 may spray wash water supplied from the external water supply on the door 112. It is the same as the water supplying 225 of the rinsing cycle 220.

Also, the door cleaning process may be performed after the rinsing 226 of the rinse cycle 220 or the filtration washing 213 of the wash cycle 210 in which the most contaminant, washing detergent, or fabric softener is stuck on the inner side surface of the door 112 is completed, or may be performed in the last course of the rinsing 226 of the rinse cycle 220 or the filtration washing 213 of the wash cycle 210. According to embodiments, when the filtration washing 213 is typically performed, the door cleaning process may be performed in the last course of the washing or after the washing is completed. Also, the door cleaning process may also be performed in the initial course of the draining 241 of the wash cycle 210 or the draining 231 of the wash cycle 230.

That is, the door cleaning process may be performed by spraying wash water supplied from an external water source toward the door 112 through the door spray portion 310, before the drum 124 is rotated at a high rate such that wash water absorbed into the laundry drains away after the drum 124 is rotated while wash water mixed with washing detergent or fabric softener is being sprayed through the circulation nozzle 127.

A washing method and a washing machine according to an embodiment of the present invention have the following effects.

First, a whirling nozzle spraying whirling water is provided to evenly spray wash water on the inner side surface and the inner rear surface of the drum.

Second, wash water supplied to the drum can be changed to whirling water.

Third, a second water supply valve and a spray nozzle are directly connected to a second water supply hose, thereby directly supplying an external water source into the drum.

Fourth, a circulation nozzle and a spray nozzle are simultaneously provided to allow the laundry to be efficiently soaked in wash water, thereby increasing washing efficiency.

Fifth, washing performance can be improved through filtration rinsing in which a spray nozzle, i.e., a whirling nozzle operates during the rinsing.

Sixth, washing performance can be improved by passing wash water supplied from an external water source through the laundry.

Seventh, washing performance can be improved through filtration washing in which a spray nozzle, i.e., a whirling nozzle operates during the washing.

Eighth, damage of the laundry can be prevented by passing wash water mixed with washing detergent through the laundry.

Ninth, wash water can be saved because only a minimum amount of wash water that can be circulated is required aside from wash water absorbed in the laundry.

Tenth, washing performance can be improved by spraying wash water through a spray nozzle that is a whirling nozzle or spraying wash water through a circulation nozzle that is a whirling nozzle during initial water supplying.

Eleventh, the laundry can be soaked in advance by spraying wash water into the drum prior to the laundry soaking.

Twelfth, since the laundry can be soaked in advance prior to the laundry soaking, washing detergent can be easily dissolved, and wash water mixed with the washing detergent can be easily absorbed into the laundry prior to the laundry soaking.

Thirteenth, since only wash water that can be circulated is required during the laundry soaking, wash water can be saved.

Fourteenth, additional water supplying can be omitted after the laundry soaking.

Fifteenth, since wash water can be dispersedly sprayed on the inner side surface 124*a* and the inner rear surface 124*b* of the drum 124 by a centrifugal force.

Sixteenth, wash water can be atomized by a centrifugal force to be rapidly absorbed into the laundry and pass through the laundry.

The effects of the present invention are not limited to the effects described above, and other effects that have not been set forth herein will be clearly understood from the appended claims by those skilled in the art.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A washing machine comprising:

a cabinet defining an exterior of the washing machine;

a drum provided in the cabinet for holding laundry and for rotating the laundry held therein;

a tub provided in the cabinet for holding wash water, wherein the tub holds the drum;

a gasket provided between the cabinet and the tub;

a spray nozzle provided at an upper portion of the gasket to spray wash water supplied from an external water source into the drum;

a pump for circulating the wash water in the tub;

a circulation nozzle provided at an lower portion of the gasket to spray circulating wash water into the drum; and a circulation flow path disposed to connect the pump and the circulation nozzle, wherein the spray nozzle comprises:

a dome having a receiving space therein; and a core provided in the receiving space and formed of a twisted plate to form a plurality of twisted flow paths together with the receiving space, wherein the wash water passing through the plurality of twisted flow paths is changed to whirling water, wherein the circulation nozzle comprises:

a main body connected to the pump and having a flow path through which the circulating wash water passes; and a bent surface, wherein the circulating wash water having passed through the flow path of the main body runs against the bent surface and is sprayed therefrom.

2. The washing machine of claim 1, wherein the spray nozzle sprays the wash water on an inner side surface and an inner rear surface of the drum.

3. The washing machine of claim 2, wherein the wash water is changed into the whirling water to be dispersedly sprayed on the inner side surface and the inner rear surface of the drum.

4. The washing machine of claim 1, wherein the wash water is changed to whirling water to perform a translational motion or a circular motion.

5. The washing machine of claim 1, wherein the wash water is changed into the whirling water to be atomized.

6. The washing machine of claim 1, wherein the gasket has a first protrusion and a second protrusion protruding at an upper portion of an inner circumferential surface of the gasket; wherein the spray nozzle is provided between the first protrusion and the second protrusion.

7. The washing machine of claim 1, further comprising:

a water supply valve unit for supplying the wash water from the external water source;

a second water supply valve provided in the water supply valve unit for controlling a flow of the wash water; and a second water supply hose disposed between the second water supply valve and the spray nozzle; wherein the second water supply hose fluidly connects the second water supply valve and the spray nozzle.

* * * * *